US011495095B2

(12) United States Patent
Cohen

(10) Patent No.: US 11,495,095 B2
(45) Date of Patent: Nov. 8, 2022

(54) SKILL-BASED REEL GAME HAVING SEQUENCES OF LETTER DISPLAY ELEMENTS

(71) Applicant: Gregory J. Cohen, Sunnyvale, CA (US)

(72) Inventor: Gregory J. Cohen, Sunnyvale, CA (US)

( * ) Notice: Subject to any disclaimer, the term of this patent is extended or adjusted under 35 U.S.C. 154(b) by 31 days.

(21) Appl. No.: 17/097,804

(22) Filed: Nov. 13, 2020

(65) Prior Publication Data

US 2021/0174649 A1 Jun. 10, 2021

Related U.S. Application Data

(63) Continuation of application No. 16/041,837, filed on Jul. 22, 2018, now Pat. No. 10,839,653, which is a continuation of application No. 15/184,361, filed on Jun. 16, 2016, now Pat. No. 10,032,340.

(51) Int. Cl.

| | |
|---|---|
| ***G07F 17/32*** | (2006.01) |
| ***A63F 3/04*** | (2006.01) |
| ***G07F 17/34*** | (2006.01) |

(52) U.S. Cl.

CPC ..... *G07F 17/34* (2013.01); *G07F 17/3213* (2013.01); *G07F 17/3262* (2013.01); *G07F 17/3274* (2013.01); *A63F 2003/0426* (2013.01)

(58) Field of Classification Search

None

See application file for complete search history.

(56) References Cited

U.S. PATENT DOCUMENTS

| | | | | |
|---|---|---|---|---|
| 5,494,295 | A | 2/1996 | Potter et al. | |
| 5,628,514 | A | 5/1997 | Nguyen et al. | |
| 6,340,159 | B1 | 1/2002 | Giangrante | |
| 6,428,412 | B1 | 8/2002 | Anderson et al. | |
| 6,869,076 | B1 | 3/2005 | Moore et al. | |
| 7,588,494 | B2 | 9/2009 | Hughs-Baird et al. | |
| 8,398,471 | B2 | 3/2013 | Duhamel | |
| 8,449,375 | B2 | 5/2013 | Oberberger | |
| 8,465,355 | B1 * | 6/2013 | Liang | A63F 13/80 463/31 |
| 10,506,031 | B1 | 12/2019 | Cheng et al. | |
| 2008/0058099 | A1 | 3/2008 | Schwartz et al. | |

(Continued)

OTHER PUBLICATIONS

Williams Gaming, printed Mar. 16, 2016, "WMS Gaming Installs First Scabble Themed Participation Gaming Devices in Nevada", http://www.gamingfloor.com/pressrel/Press_WMS_Scrabble_Nevada.html, Jun. 13, 2001, 3 pgs.

*Primary Examiner* — Damon J Pierce

(74) *Attorney, Agent, or Firm* — Newman Law, LLC

(57) ABSTRACT

A gaming system and method for a skill-based reel game that includes a sequence of letters and a game grid size are described. During a game session, a randomly selected plurality of letters are associated with a plurality of letter display elements. A game processor determines whether any of the plurality of letter display elements form a winning sequence of letter display elements that spell a word stored in a word database. The player then identifies the winning sequence with player input, such as selecting the sequence of letter display elements on a touchscreen. When the player input is received by the game processor within a preset time period, the player is awarded a game session prize.

20 Claims, 25 Drawing Sheets

(56) References Cited

U.S. PATENT DOCUMENTS

| | | | |
|---|---|---|---|
| 2011/0012305 | A1 | 1/2011 | Chariot |
| 2011/0092271 | A1 | 4/2011 | Nguyen |
| 2011/0105217 | A1 | 5/2011 | Haveson |
| 2012/0202570 | A1 | 8/2012 | Schwartz et al. |
| 2013/0190067 | A1 | 7/2013 | Saunders |
| 2015/0038205 | A1 | 2/2015 | Duluk et al. |

* cited by examiner

SKILL-BASED REEL GAME HAVING SEQUENCES OF LETTER DISPLAY ELEMENTS

CROSS-REFERENCE

This patent application is a continuation-in-part of utility patent application Ser. No. 16/041,837 filed on Jul. 22, 2018 entitled REEL GAME HAVING SEQUENCES OF LETTER DISPLAY ELEMENTS, which is a continuation of utility patent application Ser. No. 15/184,361 (now U.S. Pat. No. 10,032,340) filed on Jun. 16, 2016 entitled REEL GAME HAVING SEQUENCES OF LETTER DISPLAY ELEMENTS; and the patent applications identified above are hereby incorporated by reference.

FIELD

The present disclosure relates to a reel game having letter display elements. More particularly, the present disclosures relates to a hybrid skill-based reel gaming system having interlinked sequences of letter display elements.

BACKGROUND

Reel games are commonly wagering games operated on gaming machines, such as slot machines, which operate with a plurality of reels. The reels may include physical reels, video reels or virtual reels. A reel may include a plurality of symbols or symbol elements, each of which may be disposed on the reel at a symbol display position. During a reel game, a player may place a wager, which may cause the plurality of reels to spin until they stop. In gaming terms, each reel may stop at a location known as a "reel stop," and each reel stop may be associated with a particular symbol display position.

Generally, the popularity of wagering games with players is dependent on the likelihood (or perceived likelihood) of winning money in the game and the entertainment value of the game relative to other available gaming options. Where the available gaming options include a number of competing machines, and the expectation of winning at each machine is roughly the same (or believed to be the same), players are typically attracted to the most engaging, entertaining, and exciting machines.

Most wagering games are non-skill-based games, i.e. "games of chance." Electronically implemented games of chance employ game-logic circuitry to generate randomly determined game outcomes, i.e. random number generators ("RNGs") or pseudo-RNGs. The RNG or pseudo-RNG may include a computer processor configured to generate a series of random numbers (or pseudo-random numbers). The RNG may generate hundreds or thousands of random or pseudo-random numbers per second. Additionally, the RNG may output a particular random number in response to an event, such as, for example, in response to the placement of a wager by a player, a button press by a player, or any other player initiated stimulus.

The random output by the RNG may be mapped (e.g., by way of a mapping table) to a particular reel stop or a plurality of reel stops, depending upon the particular game mechanic. In general, the resulting game mechanic enables the set of possible game outcomes to include all of the combinations, or patterns, of reel stops associated with all of the reels involved. Winning game outcomes may occur along one or more active paylines, where a number of active paylines may be a function of a wager amount or player input. Each of the possible game outcomes may then map to a wager outcome using a table or "pay table."

The set of possible wager outcomes is typically independent of the order or sequence in which each symbol display element is presented. For example, a game outcome comprising a first symbol element, a second symbol element, and a third symbol element conventionally results in a particular wager outcome, irrespective of the order or sequence in which each symbol element is presented in the game outcome.

Skill-based games, on the other hand typically offer a greater degree of player involvement and interaction than their non-skill-based counterparts. As such, skill-based games may be more attractive to players than non-skill-based games. Unlike non-skill-based wagering games where the game outcome is based on chance, e.g. a random selection stemming from a randomly generated number, skill-based games are games in which the outcome of the game is predominantly determined by a player's physical skill, e.g. reflex or dexterity, or mental skill, e.g. logical reasoning, strategic thinking, or trivia knowledge. Many games of skill do have an element of chance, although the player's skill is the dominant factor in determining the game's outcome. Similarly, many games of chance have elements of player interaction, control, and skill; however, these player interactions, controls, and skills are not dominant factors in determining the game's outcome. Hybrid skill-and-chance games incorporate both skill-based and non-skill-based game features. A hybrid game can be typified, for example, as a game in which a combination of player skill and random chance affects outcomes of the game as determined over a predetermined period of play.

It would therefore be beneficial to provide a new and exciting gaming system that includes sequences of letter display elements and requires player skill to achieve a positive game outcome. Additionally, it would be beneficial to provide a plurality of letter display elements that may form a winning sequence that is associated with a game award when a player identifies the winning sequence. Furthermore, it would be beneficial to display a winning sequence that forms a recognizable word to the player.

SUMMARY

A gaming system and a gaming method for a skill-based reel game that includes a sequence of letters are described. The illustrative gaming system includes a housing, a display device supported by the housing, a processor configured for game play, and a tangible non-transitory memory configured to communicate with the processor. The tangible non-transitory memory has instructions stored there on that cause the processor to perform operations that include initiating a game session having a game grid size, and randomly selecting a plurality of letter display elements. The operations also include, determining whether any of the plurality of letter display elements form a winning sequence of letter display elements, receiving a player input through the touchscreen corresponding to the winning sequence of letter display elements, and awarding a game session prize based upon the plurality of letter display elements and the player input. The winning sequence of letter display elements correspond to a word stored in a word database.

In one illustrative embodiment, the letter display elements may include bonus attributes, such as a letter value multiplier and a free spin prize.

In another illustrative embodiment, the operations may further include determining the game session game grid size based upon a value of a game session initiation fee.

In a further illustrative embodiment, the operations also include initiating a second game session having a game grid size based upon the game session outcome.

In a still further illustrative embodiment, the game session may further include multiple game grids.

The gaming method operates on a processor communicatively coupled to a tangible, non-transitory, memory, and a display device. The memory has instructions stored thereon, and the display device is supported by a housing that includes a touchscreen. The gaming method includes initiating a game session having a game grid size, randomly selecting a plurality of letters, associating the selected plurality of letters with a plurality of letter display elements, displaying the plurality of letter display elements on the display device, determining whether any of the plurality of letter display elements form a winning sequence of letter display elements, receiving a player input corresponding to the winning sequence of letter display elements, and determining, in response to determining that a winning sequence is formed, an award based upon the plurality of letter display elements.

FIGURES

The present invention will be more fully understood by reference to the following drawings which are presented for illustrative, not limiting, purposes.

DESCRIPTION

Figure 1:
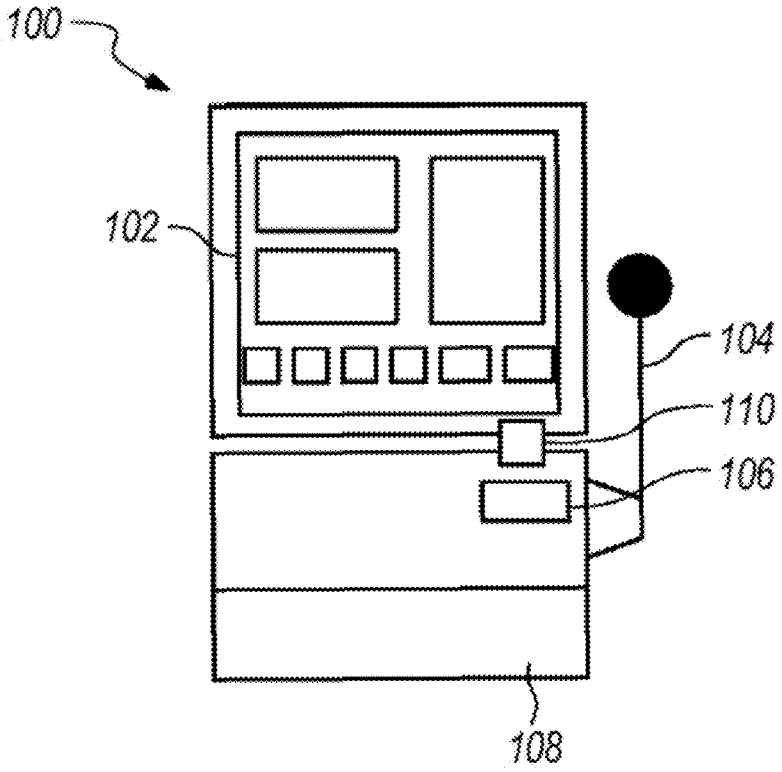
FIG. 1 shows an illustrative gaming system configured to operate the illustrative reel game presented herein.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the systems and methods described herein may vary as to configuration and as to details. The following detailed description of the illustrative embodiments includes reference to the accompanying drawings, which form a part of this application. The drawings show, by way of illustration, specific embodiments in which the invention may be practiced. It is to be understood that other embodiments may be utilized and structural changes may be made without departing from the scope of the claims. It is further understood that the steps described with respect to the disclosed process(es) may be performed in any order and are not limited to the order presented herein.

Throughout this specification and in the claims, the term "primary game session" refers to a game session that includes more than one game. A "game," as used herein, may correspond to a particular random game outcome. The primary game session may correspond to a primary or "base" game, as opposed to a bonus game, as described below. The primary game session may be initiated in response to a wager or credit being received by or transferred to the reel game. The primary game session (as well as one or more games comprising the primary game session) may also be initiated by other game events including, for example, a player selecting a "spin" button, a start button, a deal button, or any other such input selector designated for initiating a game session. The primary game session may be terminated voluntarily in response to an input by the player indicating that the player wishes to stop the game or automatically by the gaming device in response to a termination event, such as a zero credit balance in the reel game.

Further, as used herein, the terms "bonus game" and "bonus game session" refer generally to a game or a component of a game involving procedures in addition to the primary game. The bonus game session may be initiated after the primary game and in response to a particular condition. The bonus game may include a plurality of bonus game events. For example, where the primary game includes a slot machine game, the bonus game may allow players a possibility of winning more than the pay table for the primary game indicates. Typically, a bonus game outcome may depend upon a particular symbol being displayed on a slot reel when one of a plurality of final game events takes place. In addition, the bonus game outcome may depend upon winning a payout while the gaming system is in a bonus mode or "zone." In various embodiments, the outcome of the bonus game may be unrelated to the outcome of the primary game.

The combination of the primary game session and the bonus game session is generally referred as a "game session," unless another meaning is clearly intended. An individual game session is generally associated with a particular time period, and the next individual game session follows the particular time period; thus, the individual game sessions are played serially, i.e. one after the other. In addition to the individual game sessions, the systems and methods presented herein support a plurality of simultaneous game sessions that may be played during the same time period; thus, the plurality of simultaneous game sessions may indicate that a plurality of players are playing the game at the same time or that an individual player is playing a plurality of simultaneous game sessions or any combination thereof.

For the purposes of this patent, the term "game play" refers to a plurality of individual game sessions, a plurality of simultaneous game sessions or any combination thereof. For example, during "game play" a player may collect bonus words or bonus letters after one or more game sessions so that multiple bonus words or bonus letters are collected and subsequently applied to the next game session; thereby, increasing the odds of winning the bonus game in the subsequent game session.

Accordingly, the gaming system may operate as a reel game. A reel game may include one or more primary games as well as one or more bonus games. For example, a primary game may include a primary game session in which a player places a wager and reels are activated so that wheels, i.e. reels, spin. For purposes of this patent, the terms "wheel" and "reel" are used interchangeably unless another interpretation would be reached based on context.

The reel spin is represented by physical wheels, virtual wheels or any combination thereof. The spinning reels are rendered on a gaming system display. In the case of physical reels, as the reels spin, a random number may be generated and the reels may be stopped according to the random number. More particularly, the reels may be mapped to one or more reel stops based upon the random number (or a plurality of random numbers) based upon a mapping table. Where the reels are virtual, the display may map the virtual reels to a virtual or apparent reels stop based upon the random number. Alternatively, the wheel spin may be dependent on other systems or processes that cause the wheel spin to be either random or appear to be random.

Each reel may include a plurality of letter display elements. A letter display element may correspond to a letter in the alphabet (e.g., the modern English alphabet), a character from a foreign language (e.g., Japanese, Chinese, Korean, etc.), blank display element, or a wild display element. Blank display elements do not represent any letter or character, they may disrupt a winning sequence, or be replaced with a select available letter (i.e., a bonus letter or a non-excess letter, as described below). Wild display elements may represent any letter or character without the requirement that the letter or character it represents be available. Thus, as each reel randomly spins to a halt, different combinations of letter display elements may be displayed to form a particular game outcome. Some of these letter display elements may be interlinked or connected to form a word (e.g., a word in the English dictionary or a word in an abridged version of the English dictionary).

The display elements may include letters, symbols, blocks, blanks (i.e. black boxes), wild elements and other such letter display elements. For example, a "symbol" may include characters and derivatives, e.g. Japanese characters. A "wild" display element may operate in a manner similar to a wild card; thus, the wild display element may represent any other letter or symbol during the game session. A "block" display element may terminate or precede a word; thus, the "block" display element may indicate that there is a "block" between two words on the same row, column, diagonal or other such pattern.

For example, when one or more of the letter display elements include letters that can be interlinked to form a word (or words), the game outcome may include a winning game outcome (i.e., one or more winning sequences of letter display elements). A winning game outcome may correspond to a wager outcome or game award by way of a pay table. Thus, where the reels (physical or virtual) halt during a game of the primary game session to form one or more words, a player may be awarded a payout prize based upon the wager selected by the player prior to game play. In some embodiments, the awarded payout may be partially or entirely dependent on a player input that identifies the one or more words formed by the position of the reels.

By way of example and not of limitation, winning letter sequences may be formed from left to right across a plurality of reels or from right to left across the plurality of reels. Winning letter sequences may also be formed moving diagonally across a plurality of reels. For example, where a reel game includes a five-reel game, a winning letter sequence may include any number of letters that is less than or equal to five letters (i.e., one letter per reel) in the reel game, moving from left to right (including diagonal sequences) across the plurality of reels. Thus, the order or sequence in which the letters are displayed is important to the game outcome, since a plurality of letters displayed in a first order might spell a word but, in another order, might simply include gibberish.

In some embodiments, winning letter sequences may also be formed in multi-directional non-linear patterns. In these embodiments, the order and sequence in which the letters are displayed is important to the game outcome, since a plurality of letters displayed in a first order might spell a word, while in another order might not spell any words. However, unlike other embodiments, allowing winning sequences to be formed in multi-directional non-linear patterns increases the likelihood of forming a winning sequence.

In one illustrative embodiment, a letter limit may be imposed upon each of the letters capable of being displayed in the reel game. For example, each letter in the alphabet used for game play may be associated with a letter limit, and letters selected in excess of the letter limit may be eliminated. More particularly, the letter display elements associated with these "excess letters" may be populated with blanks or, stated differently, replaced with blank display elements. Blank display elements may include wild spaces capable of representing any letter, or they may be precluded from representing any letter. In the latter case, a blank display element may interrupt an otherwise winning sequence of letter display elements.

Additionally, where the gaming system determines that greater than a single word is spelled by the combination of letter display elements, the gaming system may base the wager outcome by selecting the word associated with a greatest point value (as described below), the word associated with the largest payout value, the sum of the point values of all words spelled, the sum of the payout value of all words spelled, or any combination thereof. The gaming system may further determine whether a plurality of displayed words are synonyms of each other, and if so, a synonym award (or prize) may be generated. Furthermore, the gaming system may include a list of bonus words during a primary game session. In one illustrative embodiment, bonus words may be selected for compilation at random and, during game play. Additionally, the gaming system may compare each letter sequence formed during game play to the list of bonus words. If a letter sequence formed during game play matches a bonus word, a bonus award (or prize) may be generated.

By way of example and not of limitation, bonus words may be generated during a primary game session and may be reset or cleared from memory at the termination of a primary game session. For example, a bonus word may be generated and stored during a primary game session, during game play, at random intervals during a primary game session or at any other interval or frequency during a primary game session. In another illustrative example, the bonus word is selected from a winning word. In yet another illustrative example, bonus words are collected after one or more game sessions so that multiple bonus words are collected and subsequently applied to the next game session; thereby, increasing the odds of winning the bonus game in the subsequent game session, which further increases the odds of winning the bonus game during game play.

In another non-limiting embodiment, bonus letters may be generated during a primary game session and may be reset or cleared from memory at the termination of a primary game session. For example, a bonus letter may be generated and stored during a primary game session, during game play, at random intervals during a primary game session or at any other interval or frequency during a primary game session. In another embodiment, the bonus letters are collected after one or more game sessions so that multiple bonus letters are collected and subsequently applied to the next game session; thereby increasing the odds of winning the bonus game in the subsequent game session, which further increases the odds of winning the bonus game during game play.

Referring to FIG. 1 there is shown an illustrative gaming system 100. The illustrative gaming system 100 may operate the reel game. The illustrative gaming system 100 may include an electronic device having a video display (or a plurality of physical reels) 102, a handle mechanism 104, a monetary input component 106, a communications module 108, and/or one or more input/output devices 110. The gaming system may include any electronic device capable of providing an interactive gaming experience, such as for example, a slot machine, a computer having interactive gaming software, a smartphone, a tablet computing device, and the like.

The video display 102 may include any display capable of displaying a plurality of virtual reels, such as any computer or LCD display, any gaming machine display, and slot machine display, any tablet computing device display, any smartphone display, any touchscreen display, and the like. In various embodiments, the display 102 may be included in the gaming system 100 together with a plurality of physical reels, or a plurality of physical reels may be included in the gaming system 100 as a replacement for the display 102 (e.g., where the gaming system 100 is configured as a physical reel game).

The handle mechanism 104 may include any mechanism capable of initiating a primary game session and/or a bonus game session. The handle mechanism 104 may therefore include a handle or lever that a player may pull or activate to initiate a game session.

The monetary input component 106 may include any component that is configured to receive monetary value, such as money or transferable credits. The illustrative monetary input component 106 may include a device configured to receive Ticket-In-Ticket-Out (TITO) tickets, coupons, cash, credit cards, debit cards, and other such instruments that are capable of transferring monetary value. The illustrative monetary component 106 may also be configured to receive transferable credits from an e-wallet, a smartphone, a tablet computing device, and the like. The transferable credits may be provided by a coupon based system.

The communications module 108 may include any device or system capable of communicating on a network. For example, the communications module 508 may include or enable a plurality of communications channels, such as Ethernet channels, I2C channels, RS-232 channels, USB channels, RS-485 channels, IEEE 1394 channels, Netplex channels, or any other standard or proprietary network communications channels or network communications interfaces. One or more communications channels may be configured, through the communications module 108, to operate or interface with wired and wireless communications channels. The communications module 108 may be used to communicate with personal communications devices, such as smartphones, tablet computing devices, and personal computers, and may operate using a wireless technology such as BLUETOOTH wireless technology, Wi-Fi wireless technology, or other such technologies that enable communications between the gaming system 100 and the personal communications device.

The input/output devices 110 may include input and output devices such as input buttons, bill validators, card readers, printers, displays, audio devices, bonus devices (e.g., wheels and reels), lighting devices, and the like. The input/output devices 110 may function to distribute awards or receive monetary value and may receive and/or dispense paper coupons, smart cards, magnetic stripe cards, bar codes, QR codes, or any other stored value mechanism.

Figure 2:
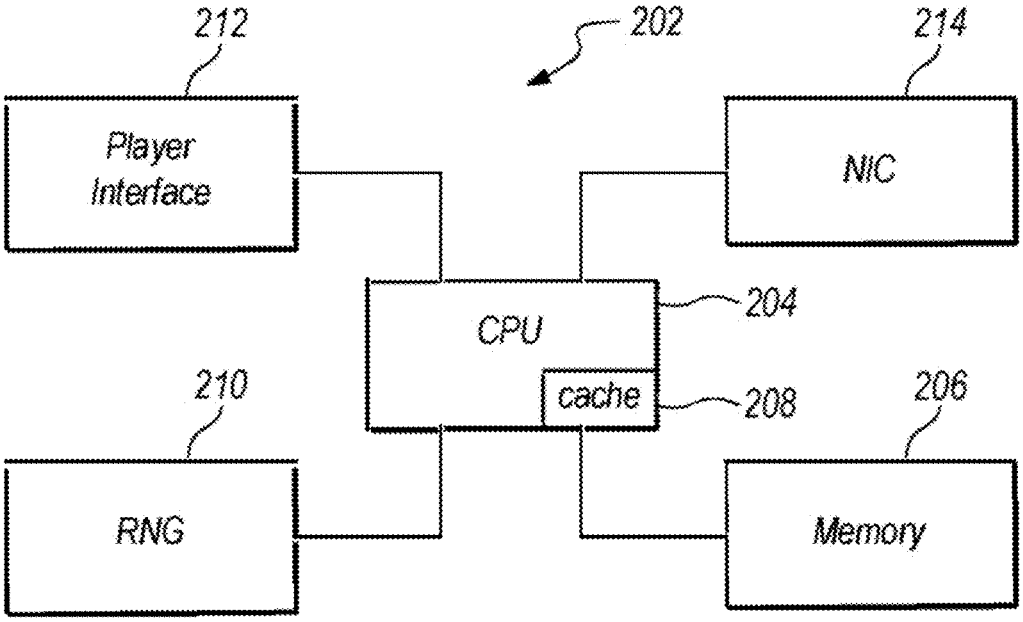
FIG. 2 shows an illustrative block diagram of the system components of the gaming system depicted in FIG. 1.

Referring to FIG. 2, there is shown a simplified illustrative block diagram of the illustrative system components 202 of the gaming system 100. The system components 202 may execute game logic for operation of the reel game, as described herein. The system components 202 may include an illustrative processor (or CPU) 204, a tangible, non-transitory, computer-readable memory 206, a fast memory cache 208, a player interface 210, a random number generator (RNG) 212, and a network interface card (NIC) 214. The system components 202 may therefore be operatively coupled to the internal components of the gaming system 100 and may function to manage the various gaming systems and operations for the gaming system 100.

In an illustrative embodiment, the illustrative processor 204 may be communicatively coupled to the tangible, non-transitory, computer-readable memory 206, which may be configured to cause the illustrative processor 204 to perform the operations described herein with respect to the reel game. The memory 206 may therefore store instructions for performing the gaming operations and processes described herein with respect to the reel game.

The fast memory cache 208 may be accessed by the illustrative processor 204 to buffer data for faster access during operation. The fast memory cache 208 may be resident on the illustrative processor 204. The illustrative processor 204 may, in addition, include something other than a traditional microprocessor, such as a field programmable gate array (FPGA), an application specific integrated circuit (ASIC), a multi-core processing system (including a plurality of processors or processing cores), and the like.

The random number generator 210 may include a software module used in the selection of at least one game symbol, game letter, or reel stop position, as described herein. In an illustrative embodiment, the random selection of a game symbol or game letter includes generating a random number and using the random number as a basis for picking at least one game symbol or game letter. It shall be appreciated by those skilled in the art that the random number generator is typically a software program that is stored in the memory 206 and executed by the illustrative processor 204.

In an illustrative embodiment, the player interface 212 may be operatively coupled to the illustrative processor 204. The player interface 212 may include any interface that permits the player to interact with the gaming system 100 and input desired gaming parameters. The player interface 212 may therefore include the display 102 and the handle mechanism 104. The player interface 212 may also include a video display having a plurality of switches, keys, or buttons that permit the player to interact with the gaming system 100. The player interface 212 may also include a computer monitor or another computing device display, such as a tablet device display, a television, a digital sign, a smartphone display, and the like. Preferably, the player interface 212 includes a monetary input component as described above.

The gaming system 100 may communicate over a network via the network interface card 214. More particularly, the network interface card 214 may permit the gaming system 100 to communicate with a plurality of other devices or gaming systems configured to play the reel game. The network interface card 214 may further permit the gaming system 100 to stream the reel game, or operations comprising the reel game, from a backend server (e.g., a WAN server), such that the illustrative processor 214 does not itself execute the reel game.

The network interface card 214 may utilize well known networking protocols to communicate with the other networked devices. These protocols may include Ethernet type protocol, TCP/IP protocols, and other such protocols. Additionally, the gaming system 100 may be networked with other gaming systems to provide a progressive jackpot. A progressive jackpot is a shared jackpot generated from the network of gaming systems.

Figure 3:
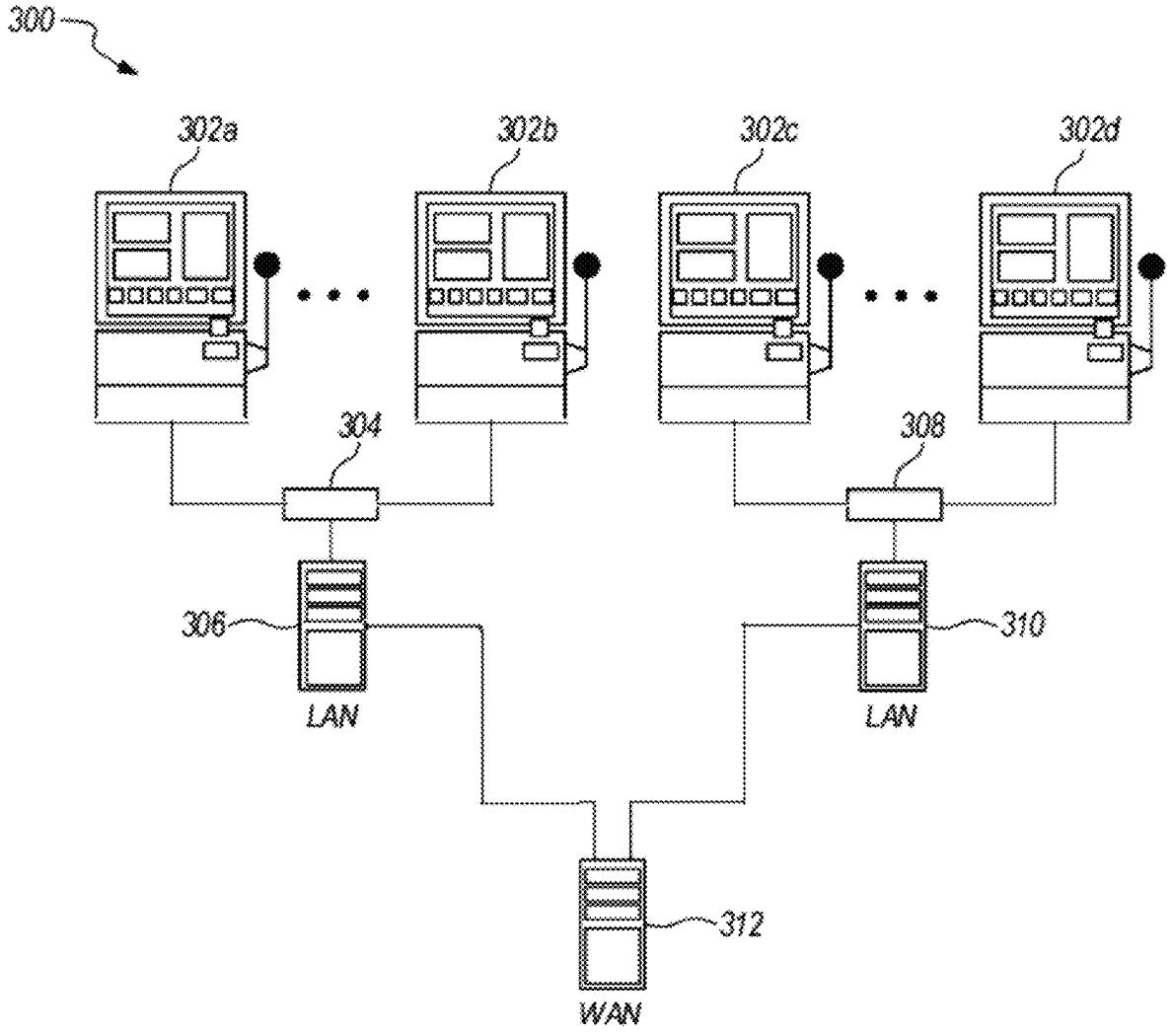
FIG. 3 shows an illustrative plurality of networked gaming systems.

Referring now to FIG. 3, there is shown an illustrative network system 300 having a plurality of networked gaming systems 302*a*-302*d*. The networked gaming systems 302*a*-302*d* may include gaming systems identical to or substantially similar to the gaming system 100. The networked gaming systems 302*a* and 302*b* may be operatively coupled to a node 304, which may facilitate communications between the gaming systems 302*a* and 302*b* and a LAN server 306. Similarly, the networked gaming systems 302*c* and 302*d* may be operatively coupled to a node 308, which may facilitate communications between the gaming systems 302*c* and 302*d* and a LAN server 310.

The nodes 304 and 308 may include hubs, routers, bridges, network switches, gateways, or any combination thereof that allows communications between the devices on the network system 300. It shall be appreciated by those skilled in the art that each LAN may operate independently.

A wide area network (WAN) may be created by linking the LANs 306 and 310. For example, both LANs 306 and 310 may communicate with a WAN server 312. For the purposes of this disclosure, it shall be appreciated that the distinction between a LAN and a WAN is primarily geographic in nature. For instance, a LAN may be geographically limited to a bank of gaming systems (e.g., gaming systems 302*a* and 302*b* or gaming systems 302*c* and 302*d*), all of which may be resident on a casino floor. A WAN may permit banks of networked gaming systems from different casino floors to be networked. A primary purpose for networking gaming systems is to generate a progressive jackpot. Additional reasons for networking include accounting, diagnostics, player tracking, and loyalty programs.

An alternative embodiment of the illustrative network system 300 includes having the game logic for the interactive game resident on a central server. The central server may be either the LAN server 306 and/or 310 or the WAN server 312. During game play, the central server may communicate game outcomes to the appropriate client (e.g., one of the networked gaming systems 302*a*-302*d*). The central server may further randomly generate and/or select one or more game symbols or game letters and may transmit the selected symbols or letters to the one or more networked gaming systems 302*a*-302*d*.

Figure 4A:
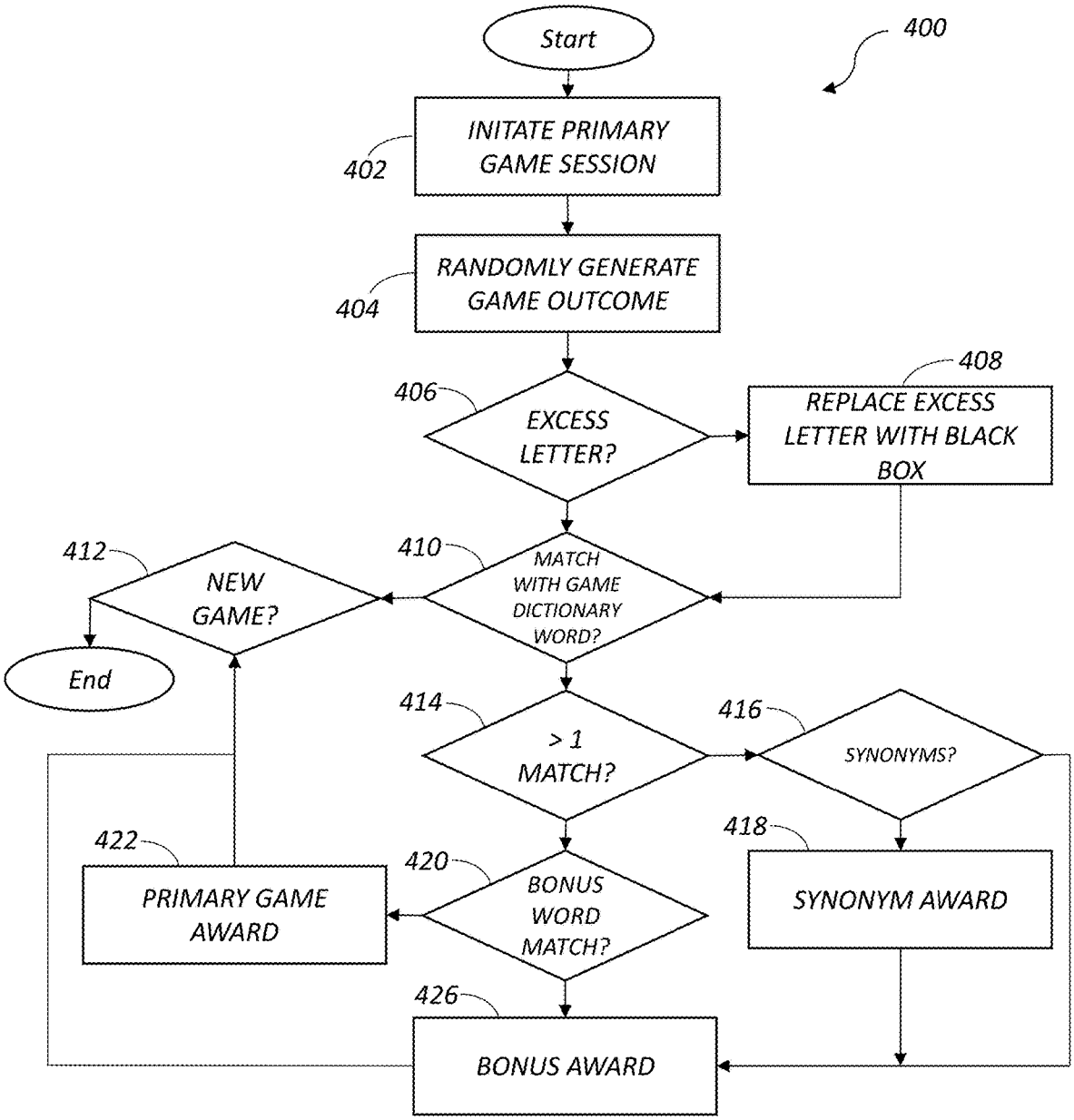
FIG. 4A shows an illustrative flowchart of the reel game with a bonus word game.

Referring now to FIG. 4A there is shown an illustrative flowchart 400 of the illustrative reel game having a bonus word game. At block 402, a player may initiate a primary game session. As described above, a primary game session may include a plurality of consecutive games. A primary game session may be initiated by a player in response to placement, by the player, of a wager. For instance, a player may transfer monetary value to the gaming system 100 (as described above), and the gaming system 100 may, in response to receiving the monetary value, initiate the primary gaming session.

Figure 5A:
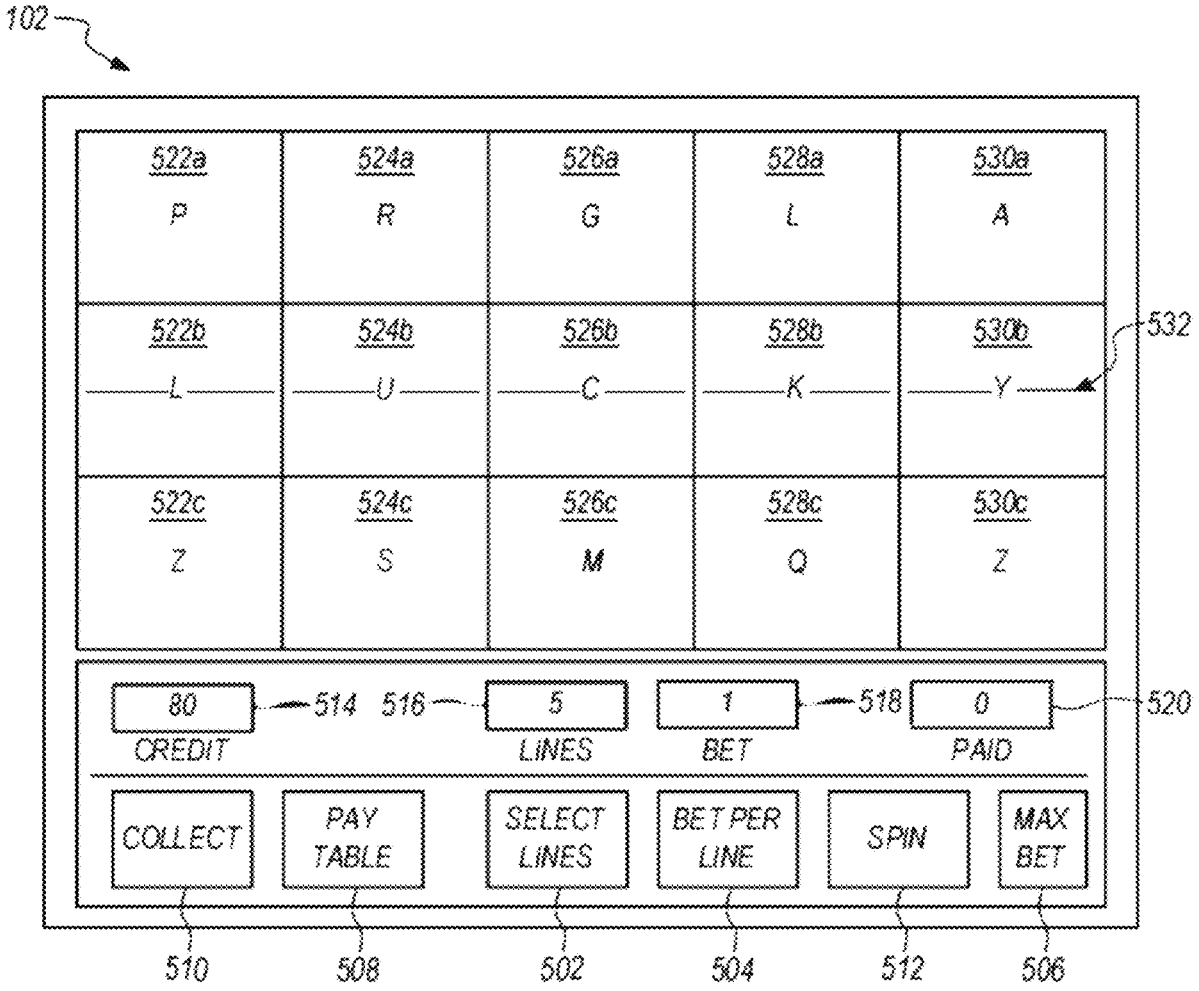
FIG. 5A shows an illustrative single player display screen of the gaming system in which a plurality of reels on a single grid display a winning sequence of letter display elements.

Referring now to FIG. 4A and FIG. 5A, a player may interact with the player interface 212 (shown in FIG. 2) to perform a variety of game operations. For instance, a player may select a variety of game parameters as shown in FIG. 5A. Each game parameter may be selected once during the primary game session, or, as those of skill in the art will appreciate, repeatedly for one or more games or subsets of games during the primary game session. Game parameters may include a player response time, a number of lines, a bet per line, and a max bet parameter. The game parameters may be associated with an input button, such as a "select lines" button 502, a "bet per line" button 504, and a "max bet" button 506. The game parameter "player response time" may be determined by the number of lines selected, the "bet per line" parameter, the "max bet" parameter, or a "player response time" button/icon (not shown). The "player response time" parameter determines the amount of time from the reveal of the final position of the reels the player has to identify winning sequences and input the winning sequences before determination of the game outcome and award (or prize). For example, a processor 204 may receive player input through a touchscreen that corresponds to a winning sequence of letter display elements within the "player response time," to achieve a winning game outcome and award.

For example, as those of skill in the art will appreciate, a player may select a number of lines (using the "select lines" button) during a primary game session or during a particular game. Each line may be associated with a wager (or bet per line), which the player may also select using, for example, the "bet per line" button. Thus, a player may wager a particular amount on a selected number of lines during any particular game. A player may further place a maximum wager (e.g., according to a maximum wagering rule associated with the reel game or according to a number of credits associated with the player's transaction account) using the "max bet" button 506.

A player may further review the pay table associated with the reel game by selecting the "pay table" button 508. A pay table may display a wager outcome for each of a plurality of game outcomes. For instance, where the reel game results in a three letter word, the pay table may indicate that a particular wager outcome (e.g., 3 times the wagered amount) will be provided to the player. Similarly, a four letter word may result in four times the wagered amount, and a five letter word may result in five times the wagered amount. Those of skill in the art will appreciate that any suitable pay table may be associated with the various possible combinations of game outcomes.

The player interface 212 (shown in FIG. 2) may further include a "collect" button 510 and a "spin" button 512. The collect button 510 may be selected by a player to terminate a primary game session and to collect the player's winnings. The spin button 512 may be selected by a player to further initiate a primary game session or a game within a primary game session. The spin button 512 may cause the gaming system 100 (shown in FIG. 1) to generate a random game outcome and an associated wager outcome. The spin button 512 may further cause the reels to spin in a physical reel game and the virtual reels to spin (or appear to spin) in a virtual reel game.

The player interface 212 may also include a plurality of game status indicators, such as a "credit" indicator 514, a "lines" or "lines selected" indicator 516, a "bet" or "wager" indicator 518, and a "paid" indicator 520.

The credit indicator 514 may display a total number of credits or total monetary value attributed to or owed to the player. For example, a player may insert twenty dollars (e.g., via a bill acceptor in the gaming system 100). The gaming system may convert the dollar amount to a credit amount, such as, for example, eighty credits, and the credit indicator may display a value of "80." The lines selected indicator 516 may display a number of lines selected for play during a particular game, such as for example, in response to a line selection operation. The bet indicator 518 may display a number of bets or credits to be bet on each selected line. For example, where a player selects a single bet per line, the bet indicator 518 may display a value of "1" to indicate that each selected line will receive a wager of a single credit. The paid indicator 520 may display a value indicating a number of credits that a player has collected during a primary game session or game within the primary game session.

In response to a selection of the spin button 512 (shown in FIG. 5A), block 404 (shown in FIG. 4A) randomly generates a game outcome. By way of example and not of limitation, the illustrative processor 204 (shown in FIG. 2) may provide an instruction to the RNG 210 requesting that the RNG 210 generate and/or transmit a generated random number (or plurality of random numbers) to the illustrative processor 204. The illustrative processor 204 may receive the random number and may determine a random game outcome based upon the random number. The random game outcome may include a plurality of symbols or letters, a plurality of reel stops associated with each symbol or letter, a plurality of symbol display elements associated with a plurality of symbols or letters, and the like.

In various embodiments, each of the randomly selected letters may be associated with a plurality of letter display elements and displayed by the illustrative processor 204 on the display 102. Alternatively, where the game system 100 includes a plurality of physical reels, the illustrative processor 204 may halt each of a plurality of reels at a reel stop that is associated with each selected letter or the reel stop associated with or mapped to each random number.

More particularly, the reel game may include a plurality of letter display elements. The number of letter display elements may depend upon a number of simulated or virtual reels or the number of physical reels, depending upon the implementation of the reel game. Accordingly, as used herein, the term "letter display element" may be used with reference to a physical reel game or a virtual reel game.

The number of letter display elements in the reel game may correspond to the number of reels used in the reel game. For example, as shown at FIG. 5A, in a five reel game, the display may include five columns corresponding to five reels 522, 524, 526, 528, and 530. Each reel may include any suitable number of letter display elements. For example, as shown, the reel 522 may include letter display elements 522*a*, 522*b*, and 522*c*. The reel 524 may include letter display elements 524*a*, 524*b*, and 524*c*. The reel 526 may include letter display elements 526*a*, 526*b*, and 526*c*. The reel 528 may include letter display elements 528*a*, 528*b*, and 528*c*. The reel 530 may include letter display elements 530*a*, 530*b*, and 530*c*.

Each letter display element may be associated with a randomly selected letter. For example, as shown, each of the letter display elements 522*a-c*, 524*a-c*, 526*a-c*, 528*a-c*, and 530*a-c* may be associated with a randomly selected letter.

At decision diamond 406, the illustrative processor 204 may determine whether one or more excess letters are present in the particular game. As used herein, an "excess letter" may include a randomly generated letter that occurs more than a predetermined number of times during a particular game. The predetermined number of letter occurrences may be referred to herein as a "letter limit." A letter limit may be particular to each letter in the alphabet used by the reel game. For example, where the reel game uses the modern English alphabet, each of the twenty-six letters comprising the alphabet may be associated with a particular letter limit. An excess letter may therefore include a randomly generated letter that occurs (during a particular game) a number of times that exceeds the letter limit for the particular letter.

The gaming system 100 may determine a number of instances or occurrences of each letter for the particular game. The illustrative processor 204 may further compare the number of occurrences of each letter to the letter limit associated with each letter, and if a letter occurs during a particular game a number of times greater than the letter limit, the illustrative processor 204 may determine that the letter is an excess letter.

Figure 5B:
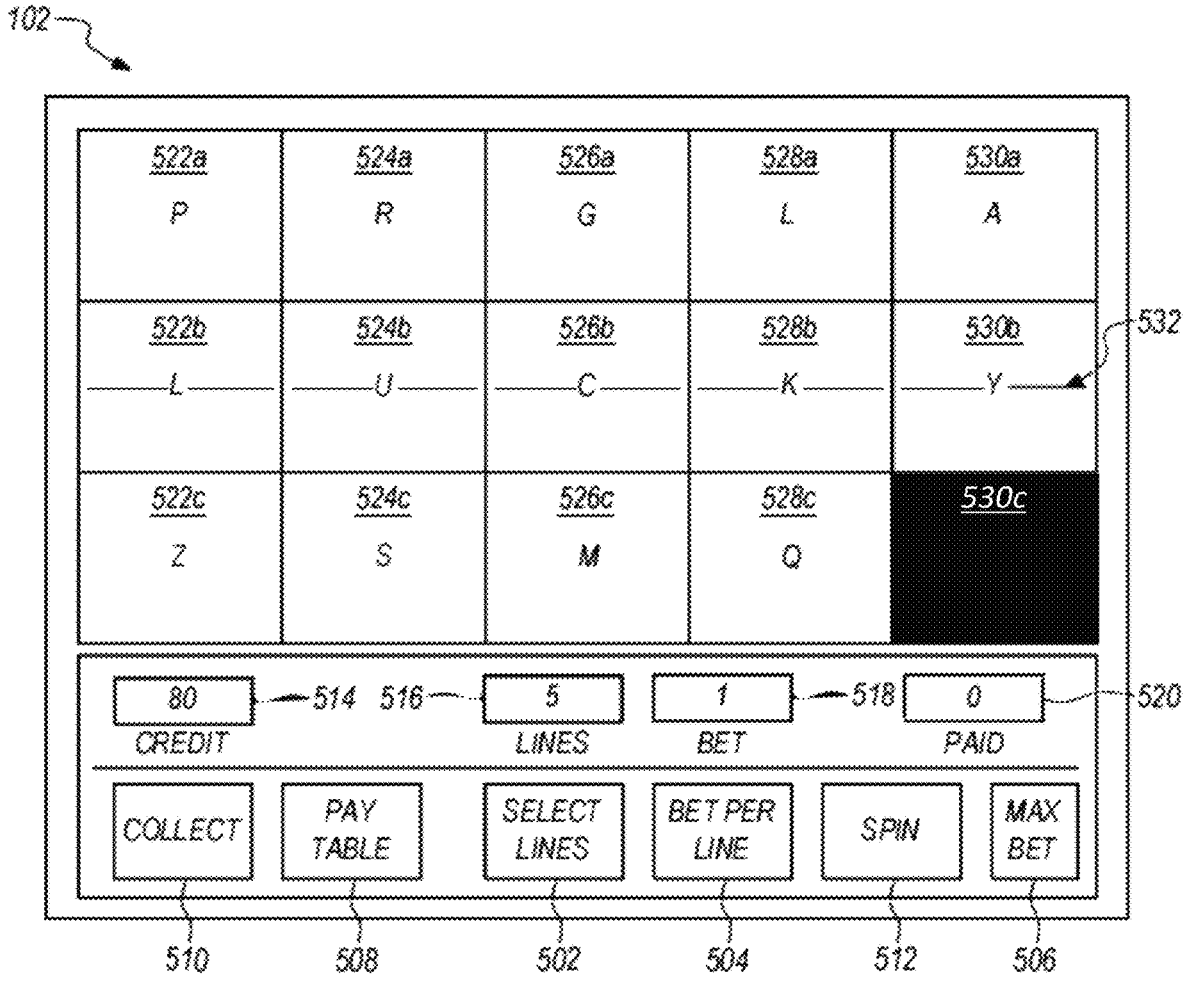
FIG. 5B shows an illustrative single player display screen of the gaming system in which a plurality of reels on a single grid display a winning sequence of letter display elements as well as in which the plurality of reels display a black box display element.

At block 408, the illustrative processor 204 may replace any excess letters with a blank display element (portrayed as a black box). At FIG. 5B, an example black box display element is depicted as black box display element 530*c*. A blank display element may include a display element that is not associated with a letter. Moreover, as described herein, during game play, a blank display element may disrupt a letter pattern such that a word may not be spelled across the blank display element. In an alternative embodiment, the illustrative processor 204 may replace one or more excess letters with a wild display element. A wild display element may represent any suitable letter. For example, a wild display element may represent any letter that would permit the spelling of a winning letter sequence (i.e., a winning word) between the wild display element and one or more adjacent letter display elements.

The term "display" element refers broadly to letters, symbols, blocks, wild, alternate elements or other such display elements. For example, a "symbol" may include characters and derivatives, e.g. Japanese characters, Chinese characters, Korean characters, etc. A "wild" display element may operate in a manner similar to a wild card; thus, the wild display element may represent any other letter or symbol during the game session. A "block" display element may terminate or precede a word; thus, the "block" display element may indicate that there is a "block" between two words on the same row, column, diagonal or other such pattern. An "alternate" display element includes any symbol, alphanumeric element or other such elements that can be used to represent a word.

At decision diamond 410, the illustrative processor 204 may determine whether any of the letter sequences displayed on the display 102 (or across the plurality of physical reels) spells or matches a word in a database of winning letter sequences (or winning words). As used herein, the database of winning words may be referred to as a "game dictionary." Each word in the game dictionary may be associated with one or more word definitions.

Winning letter sequences may be formed, as described elsewhere herein, from left to right, right to left, vertically top to bottom, vertically bottom to top, diagonally, and multi-directionally, across a plurality of reels, such as reels 522-530. More particularly, winning letter sequences may be formed between a plurality of adjacent letter display elements. A letter display element is adjacent to another letter display element when there is no interceding letter display element between the two letter display elements.

Therefore, in various embodiments, a winning sequence may be formed from left to right across a plurality of horizontally adjacent letter display elements. Winning sequences may also be formed diagonally, moving from left to right, across a plurality of diagonally adjacent letter display elements. A winning letter sequence may also be formed vertically, moving from top to bottom, down a plurality of vertically adjacent letter display elements along a particular reel, or from bottom to top, up a plurality of vertically adjacent letter display elements along a particular reel.

Furthermore, alternative embodiments may also be implemented that are specific to the underlying language. For example, Arabic is read from right-to-left and so the winning sequence is formed from right to left. In other languages, the winning sequence may be read from bottom to top or from a reverse diagonal.

At decision diamond 412, in response to a determination that no letter sequence matches a word in the game dictionary, the illustrative processor 204 may indicate that the game outcome does not include any winning letter sequences or words. The illustrative processor 204 may further determine whether to initiate a new game in the primary game session. For example, the illustrative processor 204 may receive an indication that the player wishes to continue via the spin button 512. The illustrative processor may further terminate the primary game session in response to a determination that the player has exhausted all of the player's game credits.

In the event that the illustrative processor 204 finds a match between a letter sequence and a word in the game dictionary (i.e. a winning letter sequence or a winning word), the illustrative processor 204 may generate a connecting line between the plurality of adjacent letter display elements comprising the winning letter sequence. An example connecting line 532 is shown at FIG. 5A. More particularly, the illustrative processor 204 has determined that symbol display elements 522*b*-530*b* spell the winning word "LUCKY." Thus, the illustrative processor 204 may generate the connecting line 532 for display across the symbol display positions 522*b*-530*b* to indicate that the winning letter sequence spans these symbol display elements.

Figure 5C:
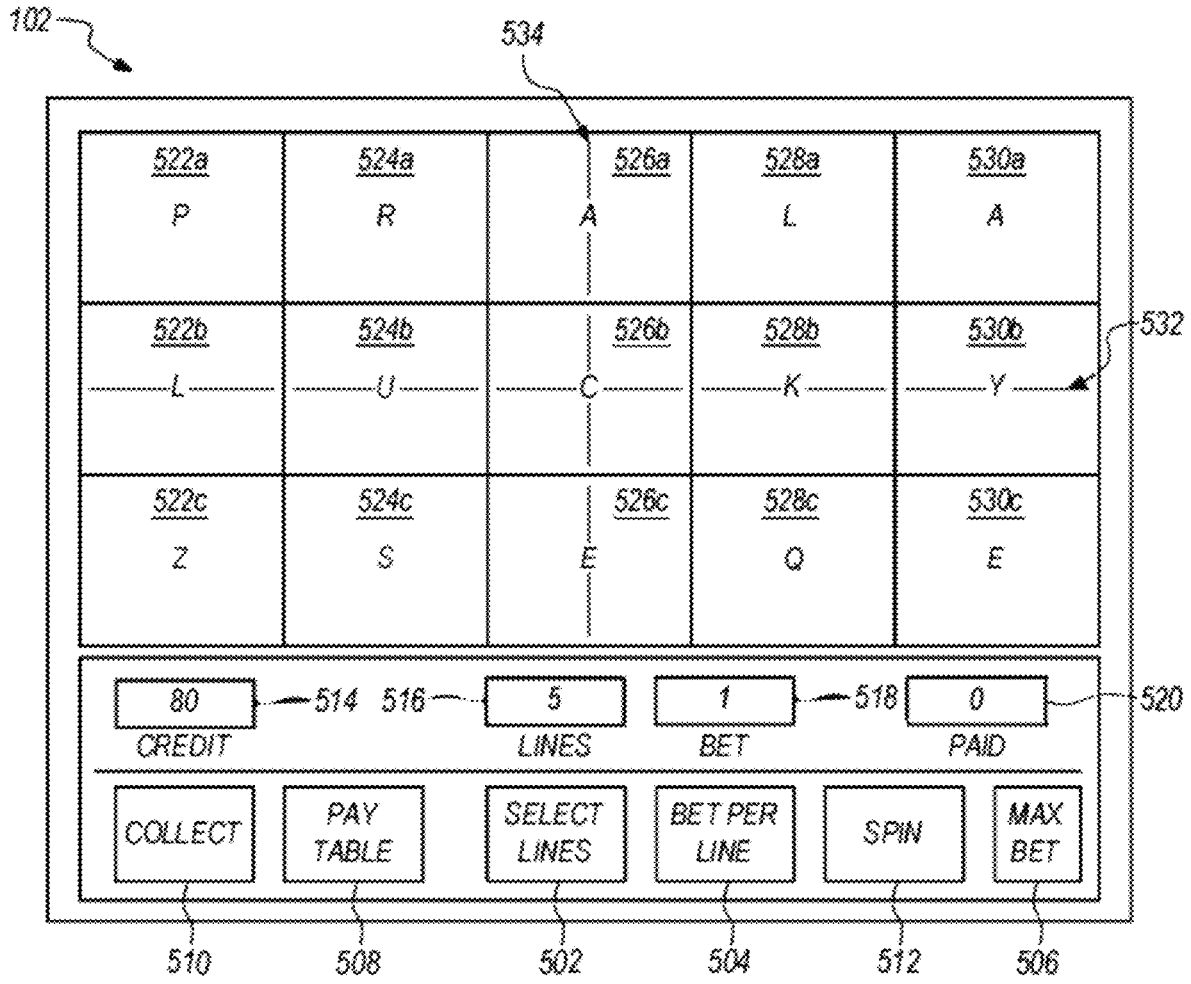
FIG. 5C shows an illustrative single player display screen of the gaming system in which a plurality of reels on a single grid display a plurality of winning sequences of letter display elements.

At decision diamond 414, the illustrative processor 204 may determine whether there is greater than a single winning letter sequence in the game outcome. A game outcome having a plurality of winning letter sequences is shown at FIG. 5C. As shown, the word "LUCKY" is spelled horizontally across adjacent letter display elements 522*b*-530*c*, and the word "ACE" is spelled vertically across adjacent letter display elements 526*a-c*. A plurality of connecting lines 532 and 534 may be generated for display by the illustrative processor 204 to highlight the winning words "LUCKY" and "ACE," respectively.

Figure 5D:
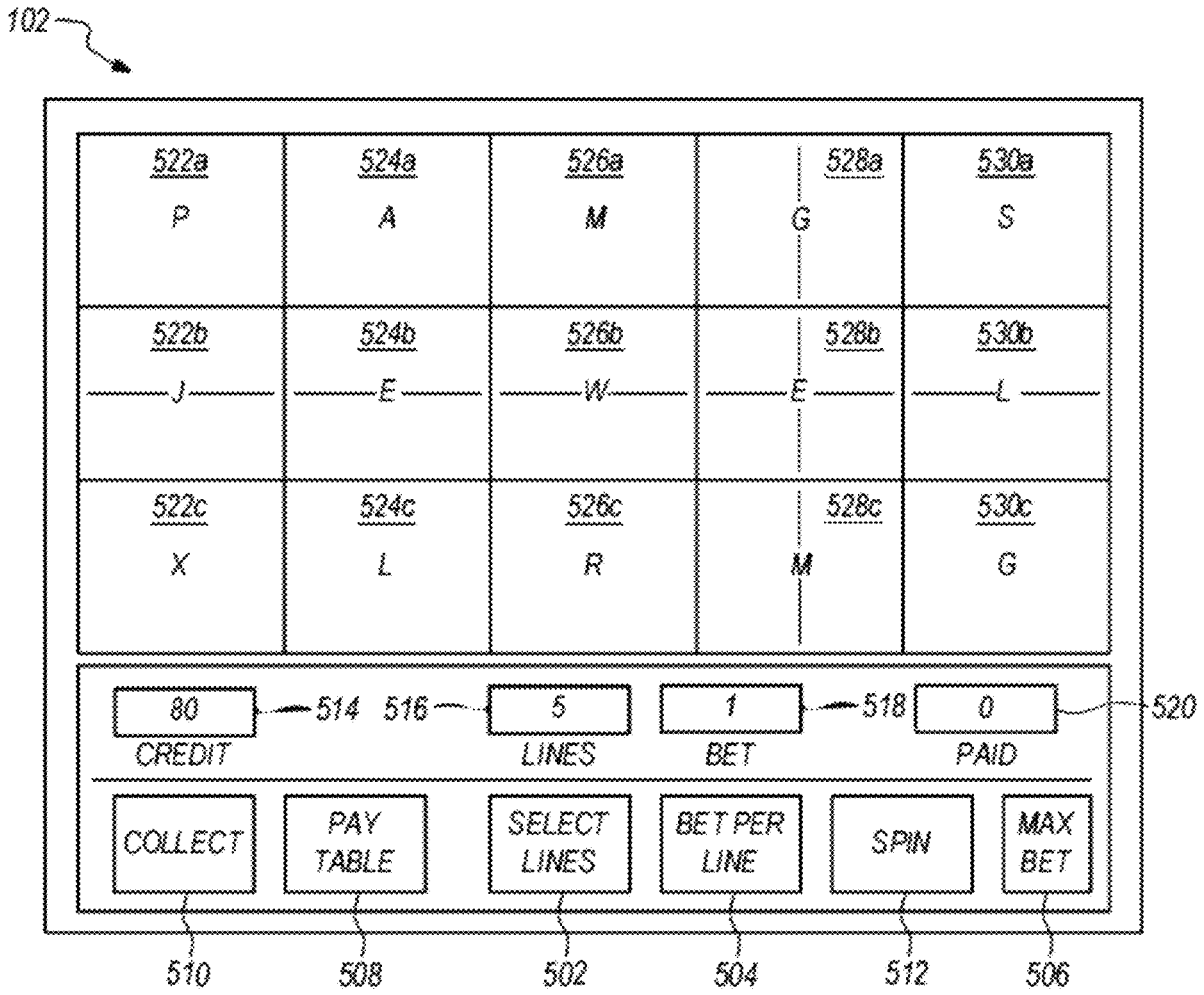
FIG. 5D shows an illustrative single player display screen of the gaming system in which a plurality of reels on a single grid display a plurality of winning sequences of letter display elements and in which the plurality of winning sequences spell synonymous words.

In response to determining that more than a single winning word has been generated in the game outcome, the illustrative processor may, at decision diamond 416, determine whether any winning word is synonym of any other winning word. A game outcome having synonymous words is shown at FIG. 5D. The word "JEWEL" is spelled across letter display elements 522*a*-522*e*, and the synonymous word "GEM" is spelled vertically across the letter display elements 528*a-c*. The game dictionary may include relationships specifying words that are synonyms. For example, where the game dictionary is stored as part of a relational database structure, synonymous words may be linked by way of a key specifying such a relationship. Thus, the game dictionary may specify that words are synonymous for the purpose of the reel game (but where, for example, another dictionary or thesaurus might not define the words as synonyms). In other words, the game dictionary may define words as synonyms in a suitable manner.

In response to determining that a word spelled in the plurality of letter display elements is a synonym of another word spelled in the plurality of letter display elements, the illustrative processor 204 may, at block 418, generate and award a synonym award (or prize). The synonym award may include any suitable award and may depend, for example, upon the complexity of the words, the likelihood of each word occurring in conjunction, and the like.

At decision diamond 420, the illustrative processor 204 may further implement a bonus game. The bonus game may broadly incorporate a comparison between one or more winning letter sequences to a list of one or more stored bonus words. Bonus words may be generated during a primary game session and may be reset or cleared from memory at the termination of a primary game session. For example, a bonus word may be generated and stored during each game of a primary game session, at random intervals during a primary game session, or at any other interval or frequency during a primary game session. Bonus words may be selected from the game dictionary. Bonus words may also be selected by players.

Furthermore, the gaming system may include a list of bonus words during a primary game session. In one illustrative embodiment, bonus words may be selected for compilation at random and during game play. Additionally, the gaming system may compare each letter sequence formed during game play to the list of bonus words. If a letter sequence formed during game play matches a bonus word, a bonus award (or prize) may be generated.

By way of example and not of limitation, bonus words may be generated during a primary game session and may be reset or cleared from memory at the termination of a primary game session. For example, a bonus word may be generated and stored during a primary game session, during game play, at random intervals during a primary game session or at any other interval or frequency during a primary game session. In another illustrative example, the bonus word is selected from a winning word. In yet another illustrative example, bonus words are collected after one or more game sessions so that multiple bonus words are collected and subsequently applied to the next game session; thereby, increasing the odds of winning the bonus game in the subsequent game session, which further increases the odds of winning the bonus game during game play.

In response to determining that no winning sequence of letters matches a bonus word, the illustrative processor 204 may, at block 424 generate a primary game award (or prize) corresponding to the one or more winning words. More particularly, each letter selected for display by the illustrative processor 204 in the reel game may correspond to a letter value. The primary game award may be calculated as a function of the letter values comprising the one or more winning words.

For example, as shown with returning reference to FIG. 5A, the letters comprising the word "LUCKY" may be associated with letters having the values "1," "1," "3," "5," and "4," respectively. The point value for the word "LUCKY" may therefore be calculated as the sum of the letter values of each letter in the word (i.e., 1+1+3+5+4=14), and the point value of the winning word may be used to calculate the primary game award. For instance, the primary game award may include the player's wager on the line forming the winning word (e.g., 2 credits) multiplied by the point value of the word (e.g., 14), in which case, for the word "LUCKY," the primary game award may include, in various embodiments and in this example, 28 credits. Those of ordinary skill will, however, appreciate that any suitable mathematical function may be used to calculate the primary game award.

Illustrative point values for each of the letters in the modern English alphabet are shown in TABLE 1 below:

TABLE 1

| Point Value: | Letters: |
|---|---|
| 1 | A, E, I, O, U, L, N, S, T, R |
| 2 | D, G |
| 3 | B, C, M, P |
| 4 | F, H, V, W, Y |
| 5 | K |
| 8 | J, X |
| 10 | Q, Z |

In another illustrative embodiment, word length may be used to determine point value independently of letter point value; thus, the word "winner" would have a higher point value than the word "lucky" because "winner" is a six letter word and "lucky" is a five letter word. In yet another illustrative embodiment, the frequency of the word being displayed could also operate independently of the letter point value.

Where there are a plurality of winning words in the game outcome, the illustrative processor 204 may select the word having the greatest point value as the basis for the primary game award (i.e., so that the player receives the largest payout). The illustrative processor 204 may, alternatively, select each of the plurality of winning words or any combination of winning words (e.g., the two winning words having the greatest point values) as the basis for the primary game award.

Where two or more words are used as the basis for the primary game award, the illustrative processor 204 may average the point values for each word to generate an average point value for use as the basis for the primary game award, or the illustrative processor 204 may add the point values for each word together to generate a larger total point value for use as the basis for the primary game award. Moreover, the primary game award may be provided to a player in addition to or in place of the synonym award. Where either the primary game award or synonym award are to be provided, but not both, the illustrative processor 204 may select the greater (or lesser) of the two awards. The illustrative processor 204 may further average, add, or otherwise combine the awards to generate a combined primary game and synonym award.

In response to determining that a winning sequence of letters matches a bonus word, however, the illustrative processor 204 may, at block 426 generate a bonus award corresponding to a bonus word multiplier times the wager amount for the line corresponding to the bonus word. The bonus word multiplier may include a predetermined multiplier, which may be stored in the game dictionary and may depend upon complexity of the bonus word, the point value of the bonus word, a likelihood that the bonus word will randomly occur, and the like or any combination thereof. The bonus award may be provided to a player in addition to or in place of the primary game award and/or synonym award. Where any of these awards are to be provided, but not all, the illustrative processor 204 may select the greatest (or least) of the awards, or the illustrative processor 204 may average, add or otherwise combine the awards to generate an averaged award (or prize). The bonus award may further average any of the primary game award, the synonym award, and the bonus award to generate a combined award (or prize).

Figure 5E:
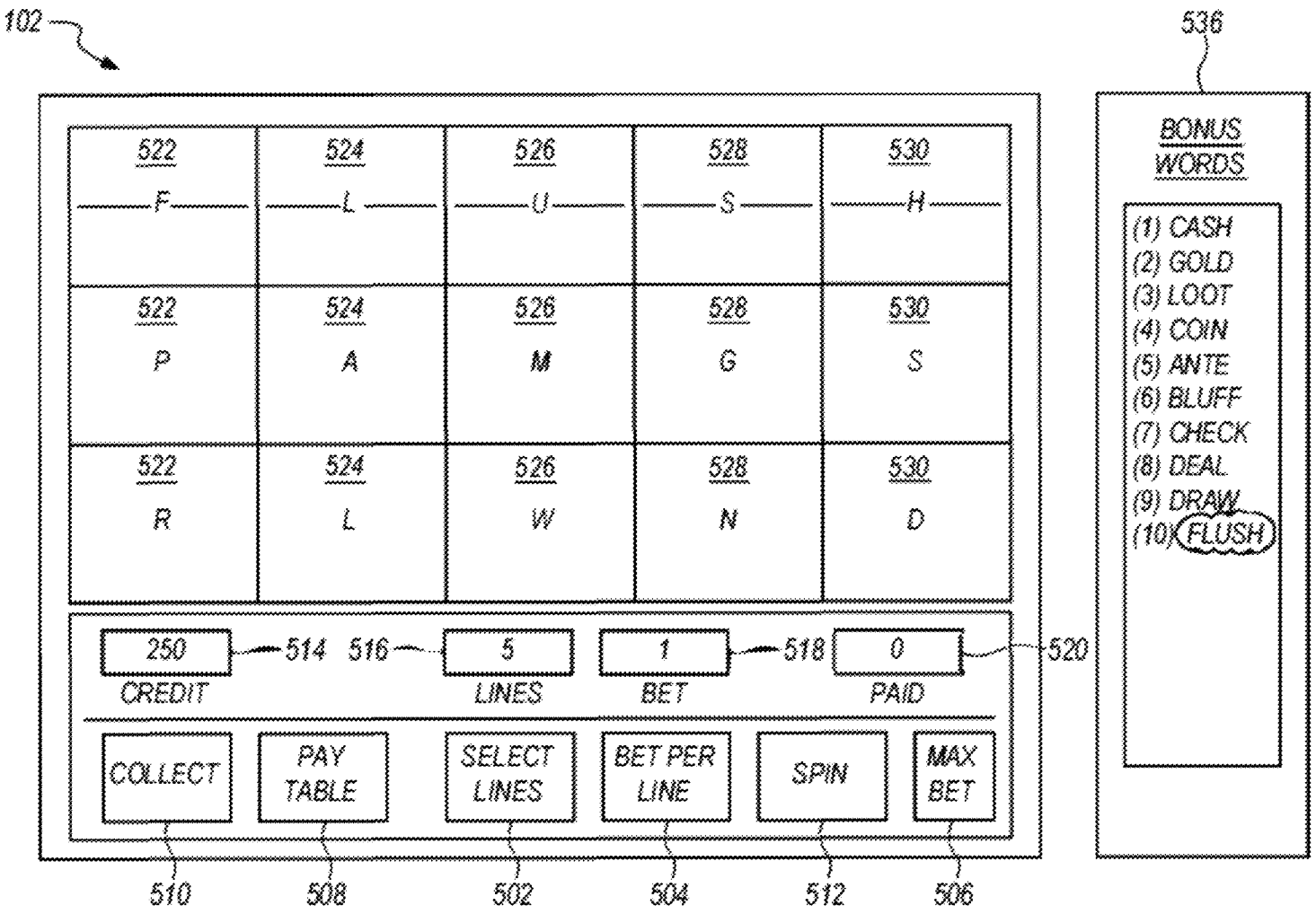
FIG. 5E shows an illustrative single player display screen of the gaming system that includes a list of bonus words.

An example bonus game is depicted with reference to FIG. 5E. As shown, the illustrative processor 204 may display a list 536 of accumulated bonus words. Each word in the list may be randomly selected during a primary game session. The list may be reset or cleared from memory in response to the termination of the primary game session or in response to a match between a winning sequence of letter elements and a bonus word. In various embodiments, the illustrative processor 204 may not display the list of accumulated bonus words. Rather, the illustrative processor 204 may maintain the list in the memory 206 as part of a bonus words database.

Accordingly, in the illustrative example, the letter display elements 522*a*-530*a* may display the word "FLUSH." The word "FLUSH" may include a word in the bonus list. The illustrative processor 204 may therefore highlight or otherwise designate the word "FLUSH" in the bonus list, as shown, as well as generate the bonus award for the player based upon the bonus word.

The reel game may include an option to display one or more definitions associated with a particular winning word, synonym thereof, or bonus word. For example, a player may select the option (e.g., by tapping on one of the letter display elements, where the display 102 includes a touch screen display, or by selecting a button on the player interface 212) to display a word definition. The word definition may be retrieved from the game dictionary by the illustrative processor 204 and displayed for the player on the display 102.

In response to generating the primary game award, the synonym award, and/or the bonus award, the illustrative processor 204 may, at decision diamond 412, determine whether to initiate a new game in the primary game session. For example, the illustrative processor 204 may receive an indication that the player wishes to continue via the spin button 512. The illustrative processor may further terminate the primary game session in response to a determination that the player has exhausted all of the player's game credits or in response to an indication that the player wishes to terminate the primary game session, such as an indication that the player wishes to collect the player's accumulated or remaining credits.

Figure 4B:
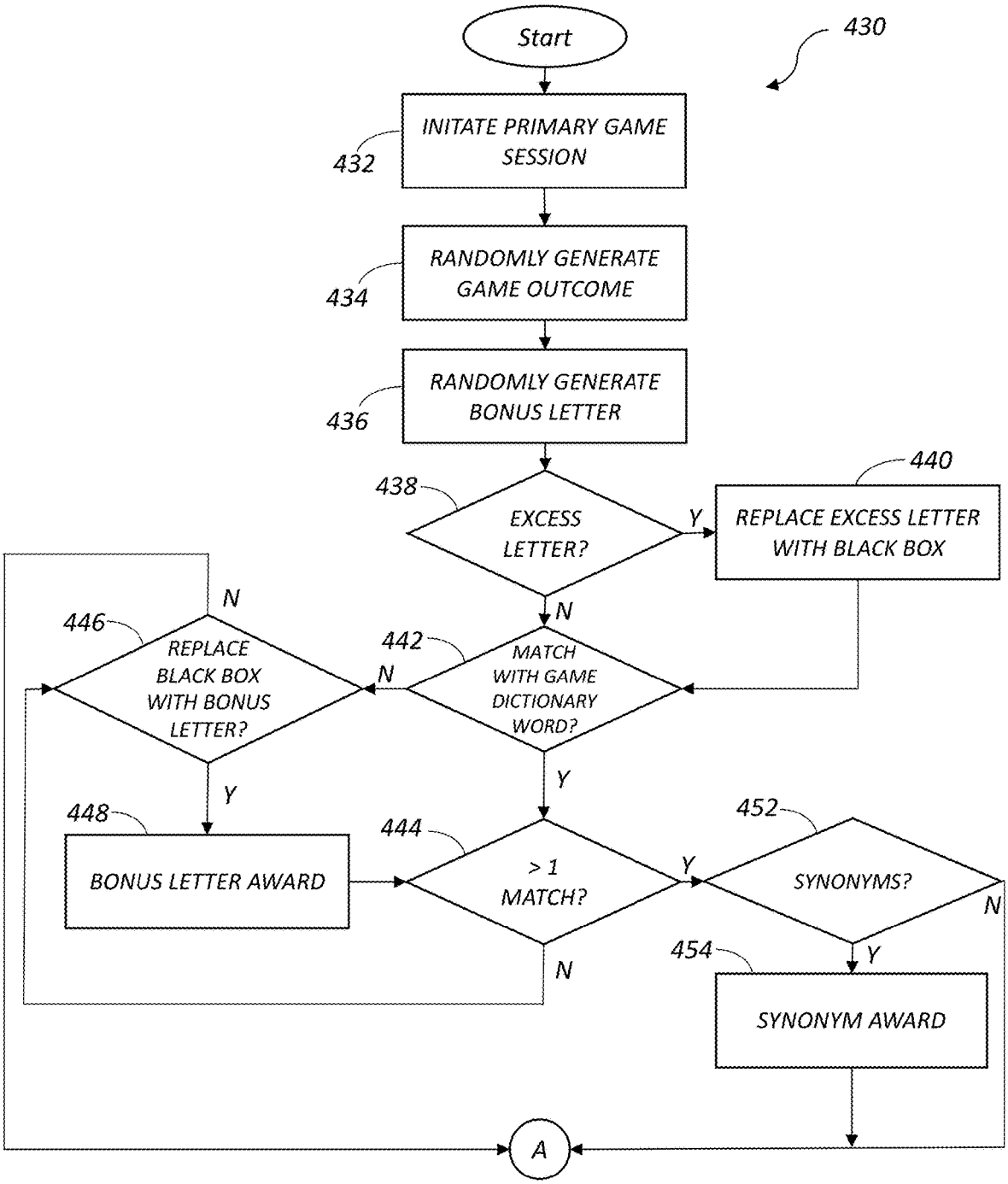
FIGS. 4B and 4C show an illustrative flowchart of the reel game with a bonus letter game and a bonus word game.
Figure 4C:
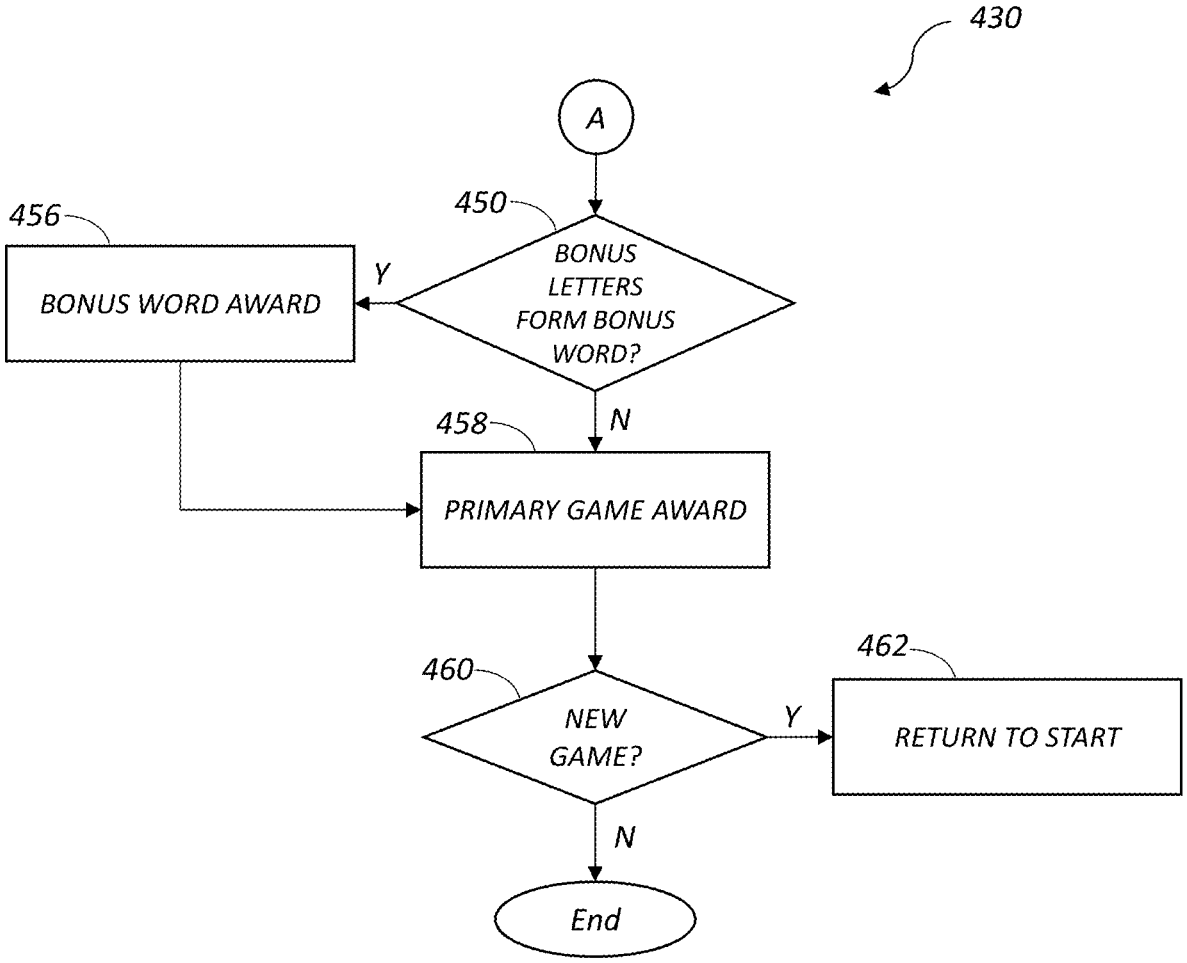

Referring now to FIGS. 4B and 4C, there is shown an illustrative flowchart 430 of the illustrative reel game having a bonus letter game. At block 432, a player may initiate a primary game session. As described above, a primary game session may include a plurality of consecutive games. A primary game session may be initiated by a player in response to placement, by the player, of a wager. For instance, a player may transfer monetary value to the gaming system 100 (as described above), and the gaming system 100 may, in response to receiving the monetary value, initiate the primary gaming session.

In response to a selection of the spin button 512 (shown in FIG. 5A-5G), block 434 (shown in FIG. 4B) randomly generates a game outcome. By way of example and not of limitation, the illustrative processor 204 (shown in FIG. 2) may provide an instruction to the RNG 210 requesting that the RNG 210 generate and/or transmit a generated random number (or plurality of random numbers) to the illustrative processor 204. The illustrative processor 204 may receive the random number and may determine a random game outcome based upon the random number. The random game outcome may include a plurality of symbols or letters, a plurality of reel stops associated with each symbol or letter, a plurality of symbol display elements associated with a plurality of symbols or letters, and the like.

An additional response to the selection of the spin button 512 (shown in FIG. 5A-5G), is the random generation of a bonus letter at block 436. The randomly generated bonus letter is stored by the processor 204 and displayed in the bonus letter list 548 by the display 102. In some embodiments, a bonus letter is randomly generated during every game session. In other embodiments, a random determination is made by the processor 204 whether to randomly generate a bonus letter for a particular game session. In still other embodiments, multiple bonus letters may be randomly generated for a single game session.

Bonus letters may accrue from game session to game session. In the illustrative bonus letter lists (FIG. 5F reference 548; and FIG. 5G reference 560), several bonus letters have accrued from one or more previous game sessions.

Figure 5F:
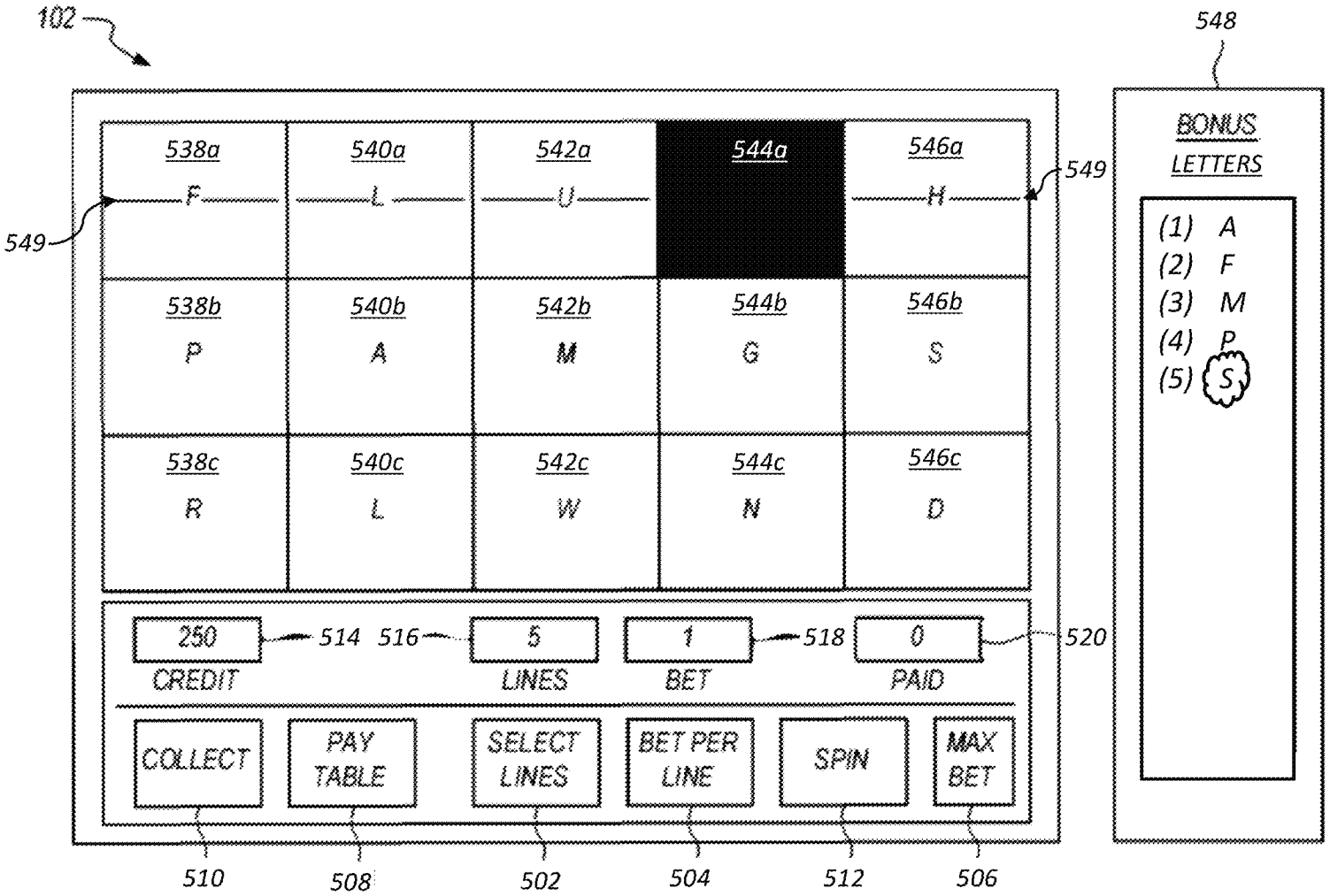
FIG. 5F shows an illustrative single player display screen of the gaming system that includes a list of bonus letters.

With reference to FIG. 5F, the bonus letter list 548 four bonus letters "A," "F," "M," and "P" that have accrued from previous game session(s) and one bonus letter "S" that may have been randomly generated during the present game session or accrued from a previous game session.

Figure 5G:
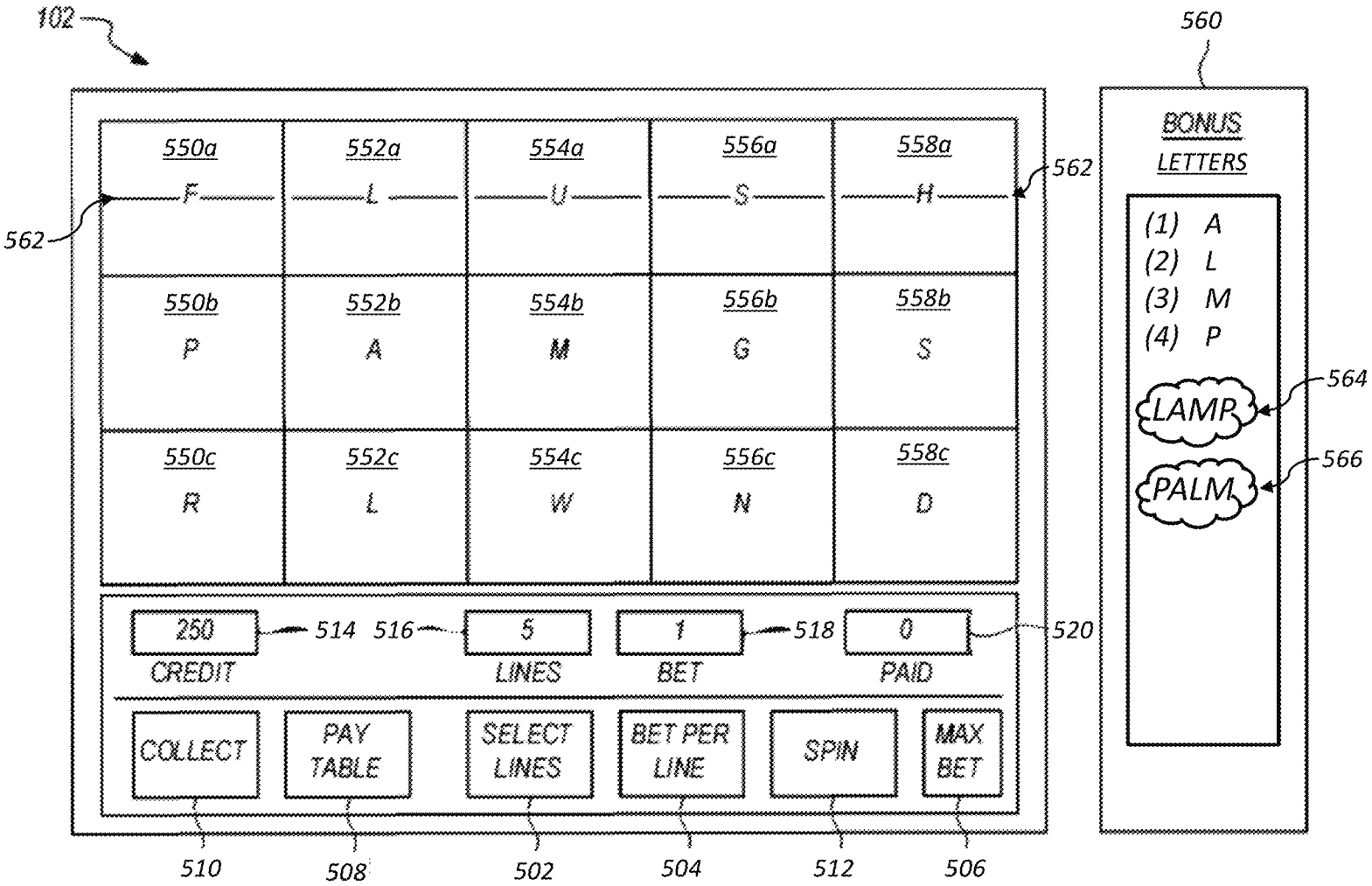
FIG. 5G shows an illustrative single player display screen of the gaming system that includes a list of bonus letters that form a bonus word.

With reference now to FIG. 5G, the bonus letter list 560 comprises four bonus letters "A," "L," "M," and "P." Two bonus words spelled by the bonus letters in the list 560 are also highlighted below the listed bonus letters.

At decision diamond 438, the illustrative processor 204 may determine whether one or more excess letters are present in the particular game. The gaming system 100 may determine a number of instances or occurrences of each letter for the particular game. The illustrative processor 204 may further compare the number of occurrences of each letter to the letter limit associated with each letter, and if a letter occurs during a particular game a number of times greater than the letter limit, the illustrative processor 204 may determine that the letter is an excess letter.

When the processor 204 determines that the randomly generated letter is an excess letter, the method proceeds to block 440. At block 440 the illustrative processor 204 may replace any excess letters with a black box display element. At FIG. 5F, an example black box display element is depicted as display element 544*a*. Upon replacing the excess letter with a block box display element, the method proceeds to decision diamond 442.

When the processor 204 determines that the randomly generated letter is not an excess letter, the method proceeds directly to decision diamond 442.

At decision diamond 442, the illustrative processor 204 may determine whether any of the letter sequences displayed on the display 102 (or across the plurality of physical reels) spells or matches a word in a dictionary database of winning letter sequences (or winning words). Each word in the game dictionary may be associated with one or more word definitions.

When the processor 204 finds a match between a letter sequence and a word in the game dictionary (i.e. a winning letter sequence or a winning word), the illustrative processor 204 may generate a connecting line between the plurality of adjacent letter display elements comprising the winning letter sequence. An example connecting line 562 is shown at FIG. 5G. More particularly, the illustrative processor 204 has determined that symbol display elements 550*a*-558*a* spell the winning word "FLUSH." Thus, the illustrative processor 204 may generate the connecting line 562 for display across the symbol display positions 550*a*-558*a* to indicate that the winning letter sequence spans these symbol display elements. The flowchart 430 then proceeds to decision diamond 444.

When the processor 204 determines that no letter sequence matches a word in the game dictionary, the flowchart 430 proceeds to decision diamond 446. At decision diamond 446 the processor may initiate a bonus letter game session within the primary game session and determine to replace the black box display element with a bonus letter from the bonus letter list. This determination may be based upon the processor 204 identifying that replacement of the black box with one or more bonus letters in the bonus letter list would result in a winning sequence. In the event that multiple black boxes are present, this determination may be made sequentially, checking first whether replacement of one black box with a bonus letter forms a winning sequence, then whether replacement of a second black box with a bonus letter forms a winning sequence. In a skill-based embodiment, the processor 204 may determine to replace the black box display element with a bonus letter from the bonus letter list based upon player input. This player input may be a player selection, touch, drag, and/or swipe on a touchscreen. In this skill-based or hybrid skill-based embodiment, the player may be required to select the bonus letter and the black box display element which it is to replace within a player response time that is set by the processor 204.

With reference again to FIG. 5F, the letter display elements 538-546 do not spell any words, and letter display element 544*a* is a black box display element. The processor 204 may determine that substitution of the bonus letter "S" from the bonus letter list 548 in place of the black box display element 544*a* would spell the winning word "FLUSH" with the letter display elements 538*a*, 540*a*, 542*a*, 544*a*, and 546*a*. Thus, the illustrative processor 204 may generate the connecting line 549 for display across the symbol display positions 538*a*-546*a* to indicate that the winning letter sequence spans these symbol display elements. Additionally, the processor 204 may remove the bonus letter "S" from the bonus letter list 548, such that the bonus letter "S" is not available for use in future game sessions unless and until the RNG 210 again randomly generates and awards the player the bonus letter "S" in a future game session.

In a skill-based or hybrid skill-based embodiment, the processor 204 may determine an amount of time for the player to identify a winning sequence. In this embodiment the player may need to perform one or more actions during this time to achieve a winning sequence and subsequently be awarded a primary game prize, a bonus prize, or any combination thereof. For example, the processor 204 may receive the player input through a touchscreen corresponding to a winning sequence of letter display elements. If the player fails to perform the one or more actions during this time, the processor 204 may determine to award the player no winning sequence and no prize; or award the player a winning sequence and a reduced prize, such as 70%, 50%, etc. of a base prize amount.

The one or more actions may include selecting the bonus letter "S," indicating with player input that the bonus letter "S" be used to replace the black box display element 544*a*, and/or indicating with player input that the letter display elements 538*a*, 540*a*, 542*a*, 544*a*, and 546*a* form a winning sequence. In some embodiments, the player must perform each action in a specified sequence to achieve the winning game outcome and be awarded a primary game prize, a bonus prize, or any combination thereof. In other embodiments, the player need only perform one of the actions to achieve the winning game outcome and be awarded a primary game prize, a bonus prize, or any combination thereof.

When the processor determines to replace a black box with a bonus letter, the flowchart 430 proceeds to block 448 where the processor may determine to grant the player a bonus letter award (or prize) for spelling a winning sequence using a bonus letter from the player's bonus letter list. Upon determining that the game outcome includes a bonus letter award, the flowchart 430 proceeds to decision diamond 444.

Returning to decision diamond 446, the processor 204 may instead determine that no winning sequences could be formed even by replacing the black box with one of the bonus letters from the bonus list. in response to a determination that no letter sequence matches a word in the game dictionary, the illustrative processor 204 may indicate that the game outcome does not include any winning letter sequences or words. When the processor makes such a determination, the flowchart proceeds to decision diamond 450.

At decision diamond 444, the illustrative processor 204 may determine whether there is greater than a single winning letter sequence in the game outcome. When the processor 204 does not determine that there is more than a single winning letter sequence, i.e. when the processor determines there is only 1 winning letter sequence, the flowchart 430 proceeds to decision diamond 446.

Returning again to decision diamond 446, the processor 204 may search for additional winning sequences resulting from replacing one or more black boxes (if present) with bonus letters from the bonus letter list. When the processor 204 determines to replace a black box with a bonus letter to form a winning sequence, the flowchart 430 proceeds to block 448 where the processor may determine to grant the player a bonus letter award for spelling a winning sequence using a bonus letter from the player's bonus letter list. Upon determining that the game outcome includes a bonus letter award, the flowchart 430 proceeds to decision diamond 444. Since this path through the flowchart 430 required the previous identification of a winning sequence, the flowchart 430 necessarily determines that more than one winning sequence have been formed and proceeds to decision diamond 452. Each time the flowchart 430 proceeds through this path may be a separate bonus letter game session. Alternatively, the bonus letter game session may make several sequential determinations to replace a black box display element with a bonus letter from the bonus letter list.

When the processor 204 determines that no more winning sequences may be formed even by replacing the black box with one of the bonus letters from the bonus list, the flowchart 430 proceeds directly to decision diamond 450.

Returning to decision diamond 444, when the processor 204 determines that there is more than a single winning letter sequence, the flowchart proceeds to decision diamond 452. At decision diamond 452, in response to determining that more than a single winning word has been generated in the game outcome, the illustrative processor may determine whether any winning word sequence is a synonym of any other winning word sequence. In response to determining that a word spelled in the plurality of letter display elements is a synonym of another word spelled in the plurality of letter display elements, the illustrative processor 204 may, at block 454, generate and award a synonym award.

Upon determining that the winning sequences are not synonyms of one another, or generating and awarding a synonym award, the flowchart 430 proceeds to decision diamond 450 and initiates a bonus word game session where the processor determines whether the bonus letters in the bonus letter list form a bonus word. In FIG. 5G, the bonus letter list 560 includes four bonus letters that form two bonus words, "LAMP" 564 and "PALM" 566. These bonus words may be any word possibly formed only by bonus letters or a list of one or more stored bonus words. Bonus words may be generated during a primary game session and may be reset or cleared from memory at the termination of a primary game session. For example, a bonus word may be generated and stored during each game of a primary game session, at random intervals during a primary game session, or at any other interval or frequency during a primary game session. Bonus words may be selected from the game dictionary. In one illustrative embodiment, bonus words may be selected for compilation at random and during game play.

In another illustrative example, the bonus word is selected from a winning word formed during the primary game session. In yet another illustrative example, bonus words are collected after one or more game sessions so that multiple bonus words are collected and subsequently applied to the next game session; thereby, increasing the odds of winning the bonus game in the subsequent game session, which further increases the odds of winning the bonus game during game play.

When the processor 204 determines that the bonus letters remaining in the bonus letter list form a bonus word, the flowchart 430 proceeds to block 456. At block 456, in response to determining that the bonus letters form a bonus word the processor 204 awards a bonus word award (or prize). Upon issuing a bonus word award, the flowchart 430 proceeds to block 458.

At block 458, the illustrative processor 204 may generate a primary game award corresponding to the one or more winning words. However, where the processor 204 determines at decision diamond 442 that no winning sequences are formed by the letter display elements on the reels, and at decision diamond 446 that no winning sequences could be formed even by replacing one or more black boxes with available bonus letters, the processor 204 may not issue a primary game award. Upon issuing (or not issuing) a primary game award the flowchart 430 proceeds to decision diamond 460.

At decision diamond 460 the illustrative processor 204 may further determine whether to initiate a new game in the primary game session by proceeding to block 462 and initiating a new game. For example, the illustrative processor 204 may receive an indication that the player wishes to continue via the spin button 512 or through player input on a touchscreen display. The illustrative processor 204 may further terminate the primary game session in response to a determination that the player has exhausted all of the player's game credits or in response to an indication that the player wishes to terminate the primary game session, such as an indication that the player wishes to collect the player's accumulated or remaining credits.

Figure 6:
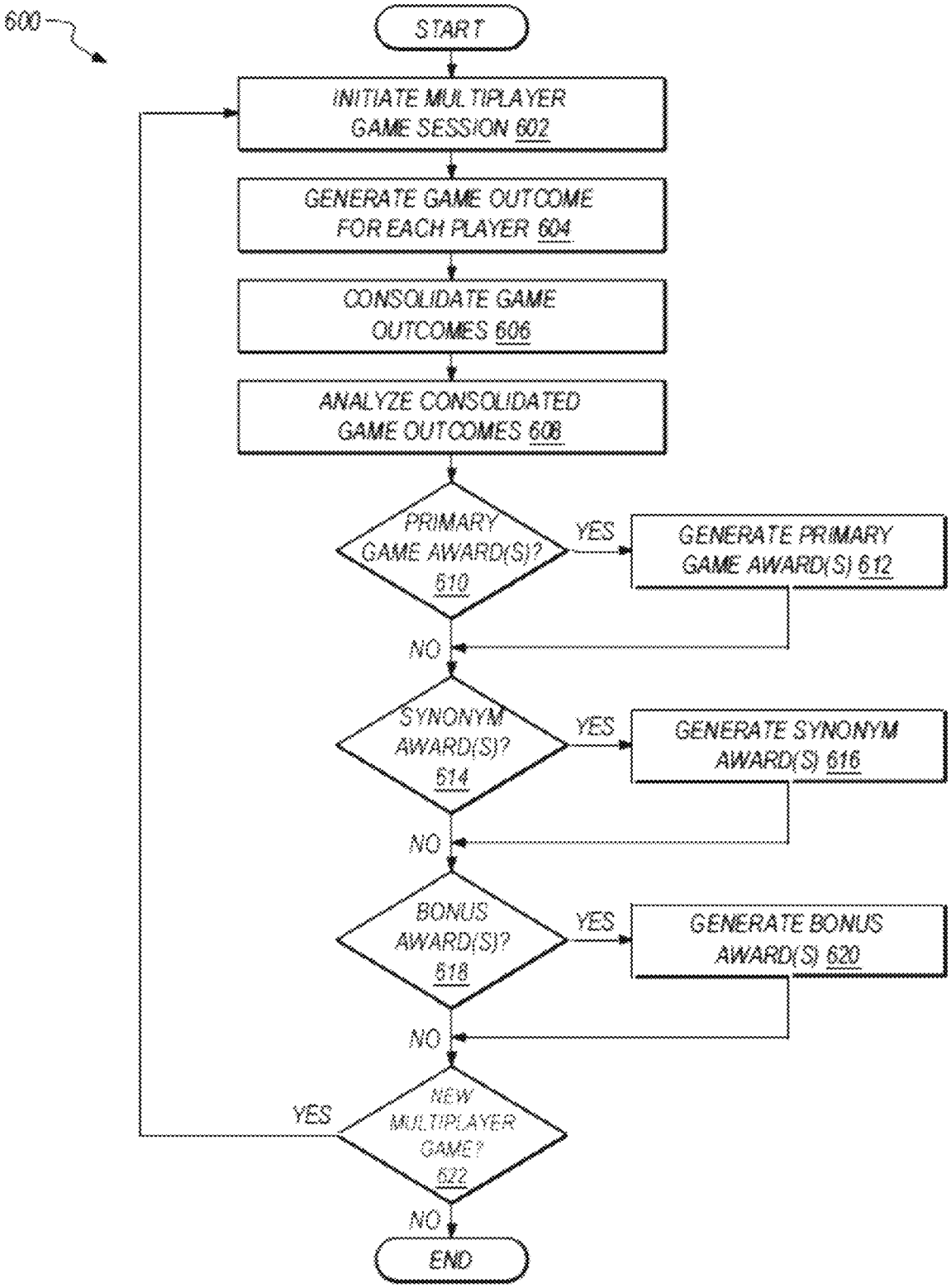
FIG. 6 shows an illustrative flowchart of a multiplayer embodiment of the reel game in which a multiplayer game outcome includes a consolidated plurality of player game outcomes.

Referring to FIG. 6 there is shown an illustrative flowchart 600 of a multiplayer reel game. At block 602, at least two players may initiate a primary multiplayer game session in the multiplayer reel game. At block 604, a game outcome for each player participating in the multiplayer game is generated. At block 606, each game outcome or multiplayer game outcome is consolidated. The multiplayer game outcome may include the game outcomes for each player in the multiplayer game.

Figure 10A:
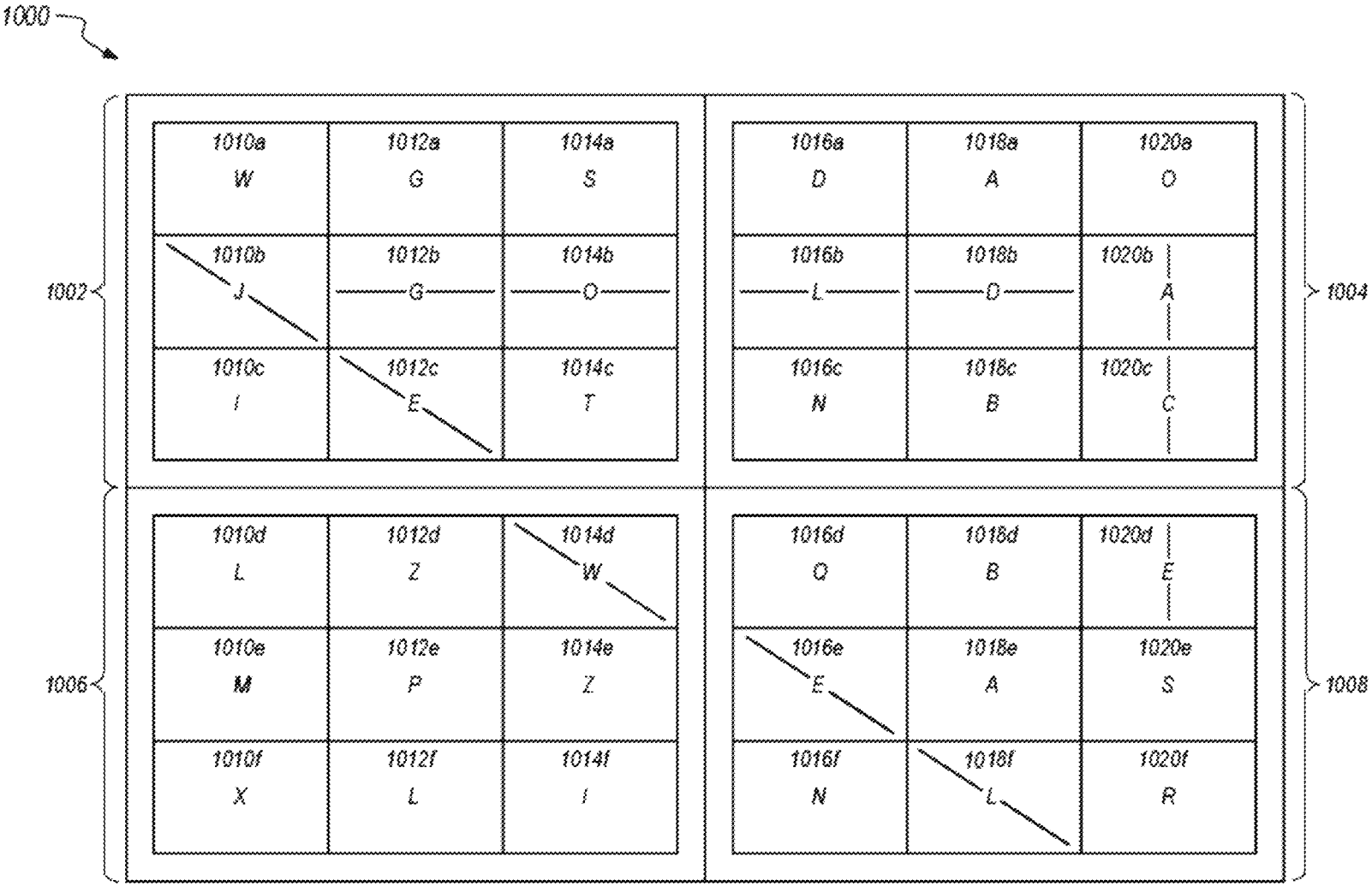
FIG. 10A shows an illustrative display screen of a multiplayer embodiment of the gaming system in which the screen display is divided into a plurality of display sections for playing a multiplayer game.

An illustrative example of the multiplayer game display is shown in FIG. 10A. The illustrative processor 204 may display the game outcome for each player in the multiplayer game display 1000 (shown in FIG. 10A). The multiplayer game display 1000 may be divided into a plurality of player display sections, and each player display section may be associated with a particular player. The number of player display sections may correspond to the number of players in the multiplayer reel game. For example, where there are four players in the multiplayer reel game, the multiplayer game display 1000 may be divided into four player display sections, such as player display sections 1002, 1004, 1006, and 1008, each of which may be associated with a particular player. Each player display section 1002, 1004, 1006, and 1008 may include the game outcome associated with a particular player in the multiplayer game.

The multiplayer game display 1000 may include a large display screen and may be located such that each of the plurality of players is able to see the multiplayer game display 1000. For example, the multiplayer game display 1000 may include a stationary or stand-alone wall mounted display, such as a flat panel television screen, a digital sign, or any other publicly accessible or publicly viewable display screen. Thus, each of the players in a multiplayer game may review the multiplayer game outcome on the multiplayer game display 1000 as well as each individual player game outcome in each of the player display sections 1002, 1004, 1006, and 1008 during game play.

At block 608, the illustrative processor 204 may analyze the multiplayer game outcome to determine whether the multiplayer game outcome includes any winning letter sequences. The illustrative processor 204 may analyze the multiplayer game outcome substantially as described above in FIG. 4. For example, the illustrative processor may determine whether the multiplayer game outcome (and/or any individual player game outcome) includes excess letters, as described above. Excess letters may be replaced with wild display elements or blank display elements.

The illustrative processor 204 may further search for winning letter sequences within the multiplayer game outcome (and/or within any individual player game outcome) from left to right across a plurality of horizontally adjacent letter display elements. By way of example and not of limitation, winning letter sequences may also be formed diagonally, moving from left to right, across a plurality of diagonally adjacent letter display elements. A winning letter sequence may also be formed vertically, moving from top to bottom, down a plurality of vertically adjacent letter display elements along a particular reel.

In the multiplayer game, winning letter sequences may be formed between individual player game outcomes. More particularly, winning letter sequences may be formed in the multiplayer game between adjacent player display sections, such as between adjacent player display sections 1002, 1004, 1006, and 1008. Thus, in the multiplayer reel game, players may spell words between the letters comprising their particular game outcome and the letters comprising game outcomes for other participating players displayed in adjacent player display sections. Accordingly, in the multiplayer reel game, players may improve their chances of forming winning letter sequences, because a greater number of letter display elements may be available for the formation of winning letter sequences.

The illustrative processor 204 may then proceed to decision diamond 610, where the illustrative processor 204 may determine whether to award a primary game award to any player in the multiplayer game. The primary game award may be associated, as described above, with a letter sequence that spells a word stored in the game dictionary. A player may receive a primary game award where the game outcome for the player spells a word in the game dictionary and/or where a word is spelled between the game outcome for the player and an adjacent game outcome for another player.

For example, at FIG. 10A, the word "GOLD" is spelled horizontally between the player display sections 1002 and 1004. Similarly, the word "JEWEL" is spelled diagonally between the player display sections 1002, 1006, and 1008, and the word "ACE" is spelled between the player display sections 1004 and 1008. Each of these words may be included in the game dictionary for the multiplayer game and so may result in a primary game award.

In various embodiments, and as shown at block 612, each player contributing to the winning letter sequence may receive the primary game award for the entire winning letter sequence. For example, for the word "GOLD," the players associated with the player display sections 1002 and 1004 may each receive the primary game award for the word "GOLD." Likewise, for the word "JEWEL," the players associated with the player display sections 1002, 1006, and 1008 may each receive the primary game award for the word "JEWEL," and for the word "ACE," the players associated with the player display sections 100 and 1008 may each receive the primary game award for the word "ACE."

In various embodiments, the primary game awards resulting from a particular primary game session in the multiplayer game may be added or aggregated to generate an aggregated primary game award, and the aggregated primary game award may be evenly distributed between each of the players in the multiplayer game or, in alternative embodiments, proportionally between each player in the multiplayer game contributing to the aggregated primary game award (i.e., between each player contributing to at least one winning letter sequence in the primary multiplayer game session).

Figure 10B:
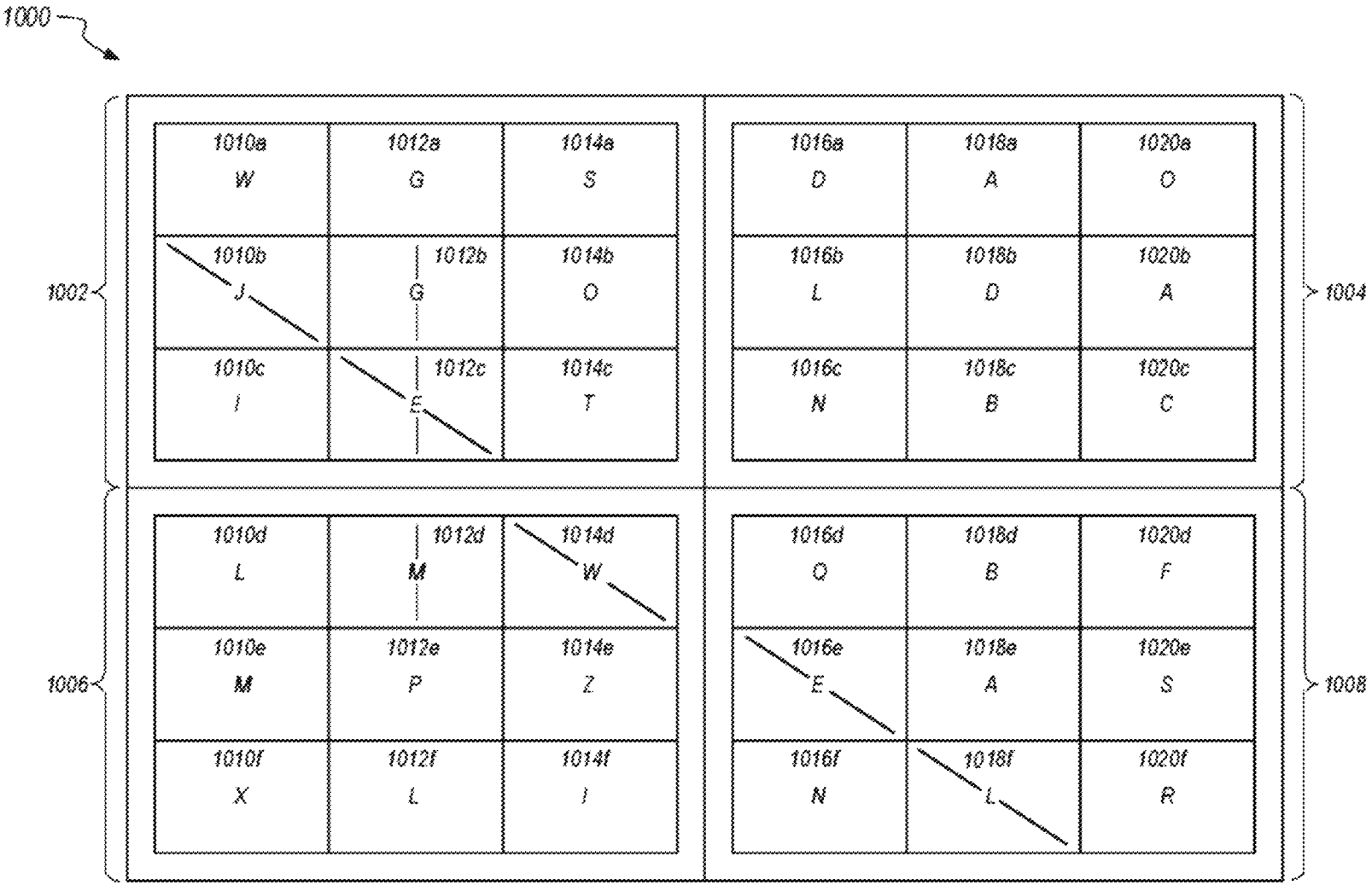
FIG. 10B shows an illustrative display screen of a multiplayer embodiment of the gaming system in which the screen display is divided into a plurality of display sections for playing a multiplayer game and in which a plurality of synonyms are displayed.

At decision diamond 614, the illustrative processor 204 may determine whether to award a synonym award to any player in the multiplayer game. The synonym award may be associated, as described above, with at least two letter sequences that spell words that are defined as synonyms in the game dictionary. A player may receive a synonym award where the game outcome for the player spells at least two synonyms and/or where the game outcomes for at least two players in the multiplayer game are synonyms. An example game display 1000 including the synonyms "JEWEL" and "GEM" is shown at FIG. 10B.

At block 616, each player contributing to the synonymous letter sequences may receive the synonym award. The synonym award may result from a particular primary game session in the multiplayer game may be added or aggregated to generate an aggregated synonym award. Additionally, the aggregated synonym award may be evenly distributed between each of the players in the multiplayer game. Alternatively, the synonym award may be proportionally distributed between each player in the multiplayer game; for example, the synonym award may be proportionally distributed between each player contributing to at least one synonymous winning letter sequence in the primary multiplayer game session.

At decision diamond 618, the illustrative processor 204 may determine whether to award a bonus award to any player in the multiplayer game. The bonus award may be associated, as described above, with a word in a list of randomly selected bonus words. A player may receive a bonus award where the game outcome for the player spells a bonus word in the list of bonus words and/or where the game outcomes for at least two players in the multiplayer game collectively spell a word in the list of bonus words.

Figure 10C:
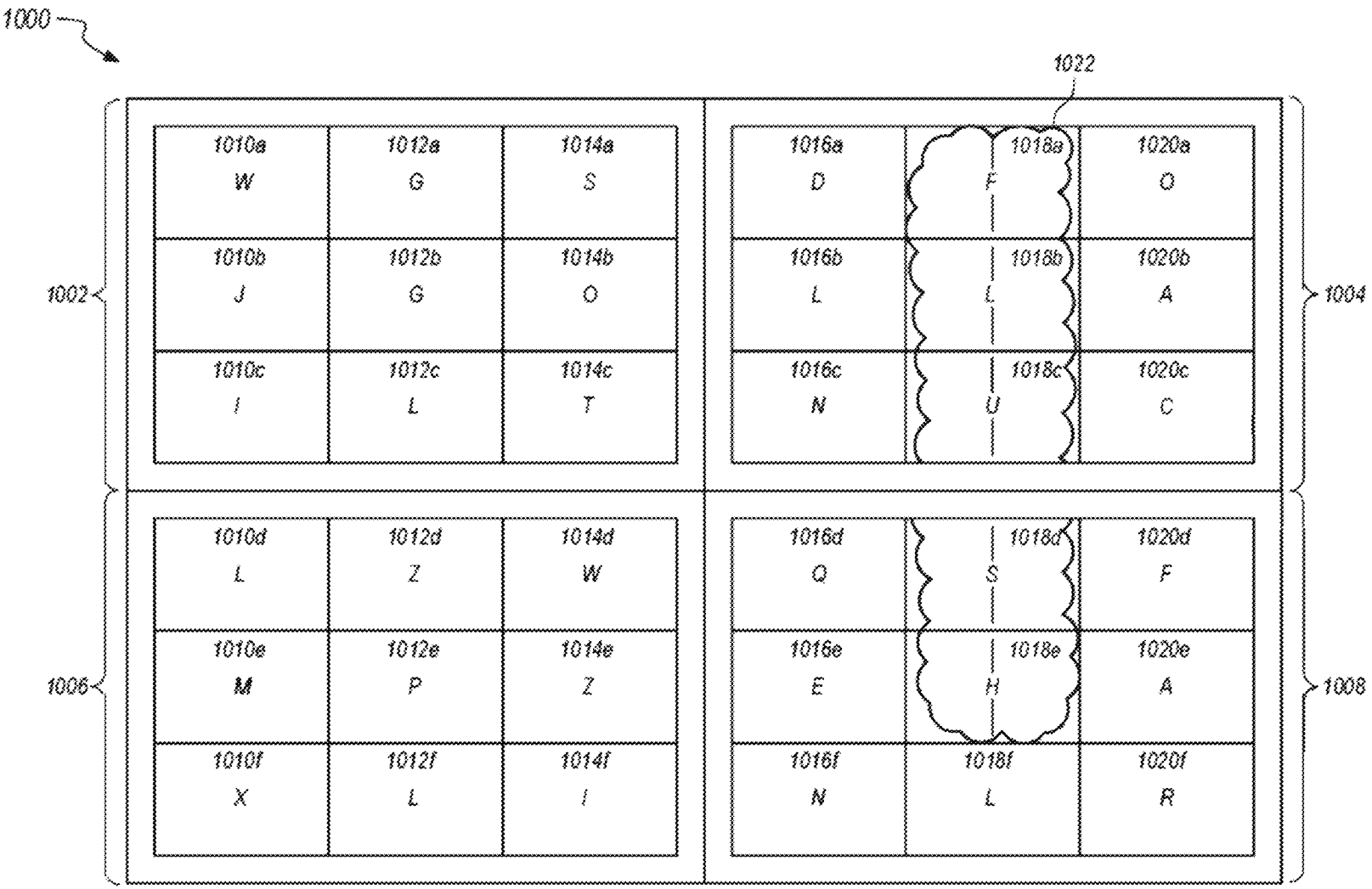
FIG. 10C shows an illustrative display screen of a multiplayer embodiment of the gaming system in which the screen display is divided into a plurality of display sections for playing a multiplayer game and in which a bonus word is displayed.

An example game display 1000 including the bonus word "FLUSH" is shown at FIG. 10C. The bonus word may be outlined or illuminated by a highlighting element 1022, as shown, to highlight that the word is a bonus word. Moreover, although not shown, the highlighting element 1022 may be applied to any winning word in the reel game as described herein, including to a plurality of synonymous words as well as to one or more words associated with a primary game award.

As shown at block 620, each player contributing to the bonus letter sequences may receive the bonus award. The bonus award(s) resulting from a particular primary game session in the multiplayer game may be added or aggregated to generate an aggregated bonus award, and the aggregated bonus award may be evenly distributed between each of the players in the multiplayer game or, in alternative embodiments, proportionally between each player in the multiplayer game contributing to the aggregated bonus award (i.e., between each player contributing a letter or letters to at least one bonus word in the primary multiplayer game session).

In various embodiments, any of the primary game award (s), the synonym award(s), and the bonus award(s) may be averaged, added, or otherwise combined to produce a combined award. The combined award may be allocated between each player in the multiplayer game in any suitable manner. The combined award may be further allocated, in alternative embodiments, between each player in the multiplayer game associated with at least one letter contributing to the generation of the combined award.

At block 622, the illustrative processor 204 may present an option to continue playing the multiplayer game (or to play a new multiplayer game). This option may be presented to each player individually or the option may be presented to the multiplayer group as a whole. Where the option is presented to each player individually, if any player chooses to quit the multiplayer game, the process 600 may end for the terminating player, and the players remaining in the multiplayer game may resume play at block 602. Where the option is presented to the group as a whole, if any player chooses to quit the multiplayer game, the process 600 may end for each player in the group, and any player wishing to continue play may be required to initiate a new multiplayer game at block 602.

Figure 7:
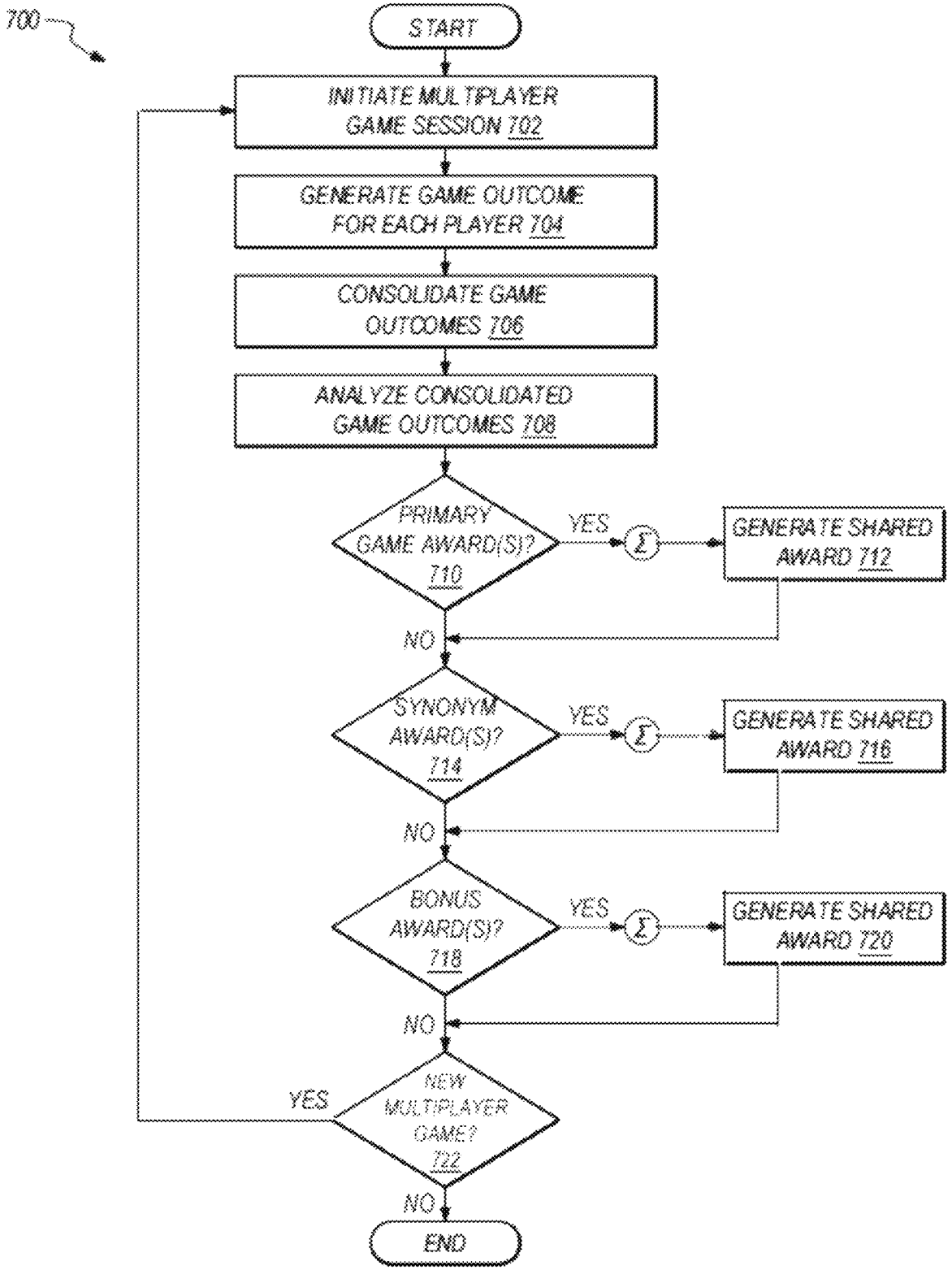
FIG. 7 shows an illustrative flowchart of a multiplayer embodiment of the reel game in which a multiplayer game outcome includes a consolidated plurality of player game outcomes and in which a plurality of awards are aggregated and shared.

Referring to FIG. 7 there is shown an illustrative flowchart 700 of a multiplayer reel game in which one or more awards are aggregated. FIG. 7 is similar to previously described FIG. 6 and thus the various methods presented in FIG. 6 are also incorporated into FIG. 7. The method 700 is initiated at block 702 where at least two players may initiate a primary multiplayer game session in the multiplayer reel game. At block 704, at least one game outcome is presented to each player participating in the multiplayer game. At block 706, the illustrative processor 204 may consolidate each game outcome to create a consolidated or multiplayer game outcome. At block 708, the multiplayer game outcome is analyzed to determine whether the multiplayer outcome includes any winning letter sequences.

As described above, an example multiplayer game display is shown with respect to FIG. 10. The multiplayer game display 1000 may include a large display screen and may be located such that each of the plurality of players is able to see the multiplayer game display 1000. Thus, each of the players in a multiplayer game may review the multiplayer game outcome as well as each individual player game outcome during game play. At decision diamond 710, the illustrative processor 204 may determine whether to award a primary game award to any player in the multiplayer game.

In various embodiments, and as shown at block 712, the primary game awards resulting from a particular primary game session in the multiplayer game may be added or aggregated to generate an aggregated primary game award. The aggregated primary game award may be evenly distributed between each of the players in the multiplayer game or, in alternative embodiments, proportionally between each player in the multiplayer game contributing to the aggregated primary game award.

An aggregated primary game award may be distributed proportionally between players based upon a proportion or percentage of the total letter value associated with the letters contributed by the player to the winning letter sequence. For instance, for the word "GOLD," the letters "GO" are associated with a letter value of "3" (2+1=3), and the letters "LO" are associated with a letter value of "3" (1+2=3). Therefore, the player associated with the letters "GO" may receive 50% of the primary game award, because the word "GOLD" is associated with a total letter value of "6," and the player associated with the letters "GO" contributed 3/6, or 50%, of the total point value to the word. Likewise, the player associated with the letters "LO" may receive 50% of the primary game award, because the player associated with the letters "LO" contributed 3/6, or 50%, of the total point value to the word.

At decision diamond 714, the illustrative processor 204 may determine whether to award a synonym award to any player in the multiplayer game. As shown at block 716, the synonym awards resulting from a particular primary game session in the multiplayer game may be added or aggregated to generate an aggregated synonym award, and the aggregated synonym award may be, like the primary game award described above, evenly distributed between each of the players in the multiplayer game or, in alternative embodiments, proportionally between each player in the multiplayer game contributing to the aggregated synonym award.

At decision diamond 718, the illustrative processor 204 may determine (as described previously) whether to award a bonus award to any player in the multiplayer game. As shown at block 720, the bonus awards resulting from a particular primary game session in the multiplayer game may be added or aggregated to generate an aggregated bonus award, and like the primary game award described above, the aggregated bonus award may be evenly distributed between each of the players in the multiplayer game or, in alternative embodiments, proportionally between each player in the multiplayer game contributing to the aggregated bonus award. At block 722, the illustrative processor 204 may present an option to continue playing the multiplayer game (or to play a new multiplayer game).

Figure 8:
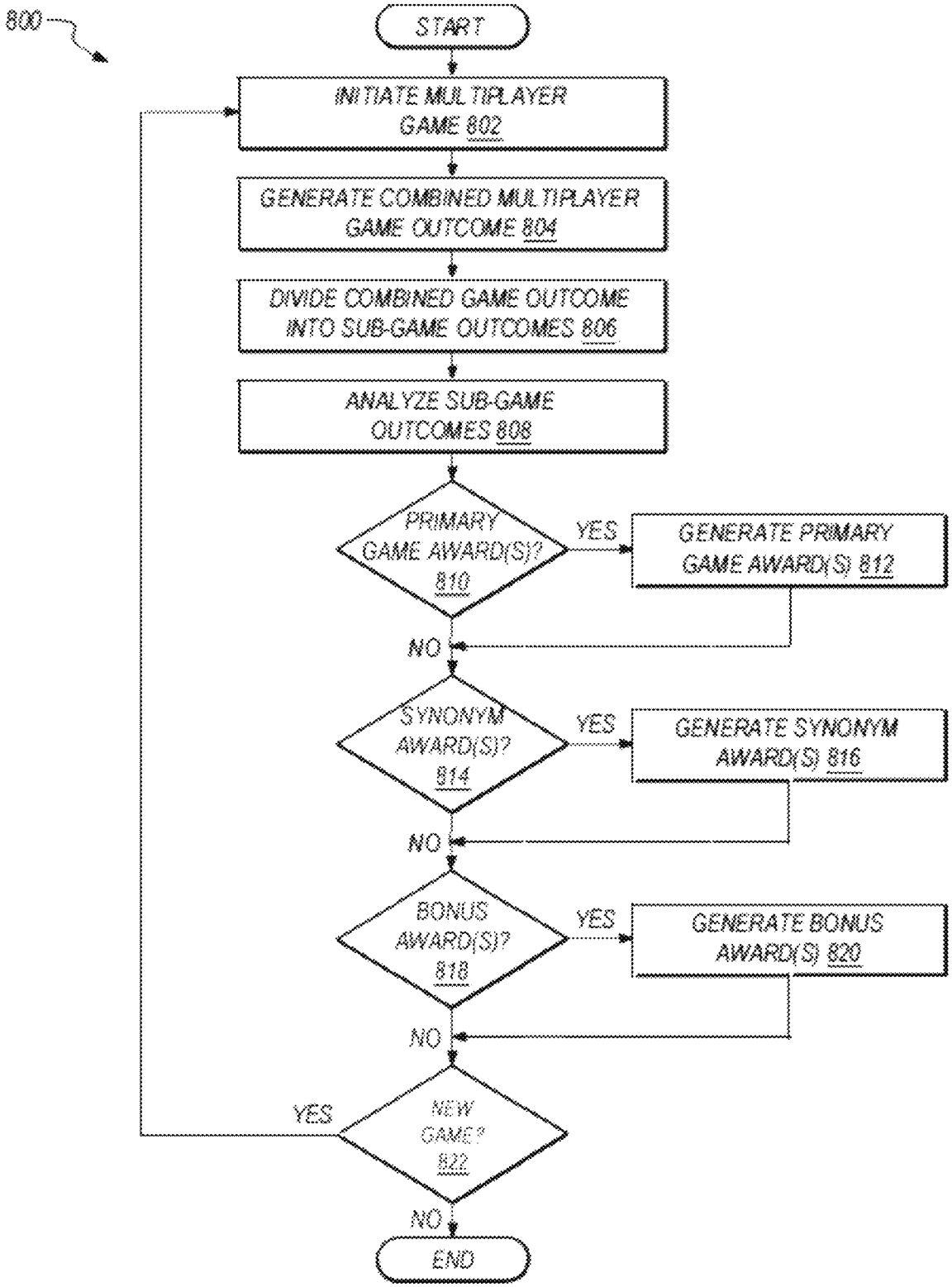
FIG. 8 shows an illustrative flowchart of a multiplayer embodiment of the reel game in which a multiplayer game outcome is divided according to a number of players to generate a plurality of player game outcomes.

Referring to FIG. 8 there is shown an illustrative flowchart 800 of a multiplayer reel game, in which the multiplayer game outcome is divided into a plurality of sub-game outcomes for each player. FIG. 8 is similar to previously described FIG. 6 and thus the various methods presented in FIG. 6 are also incorporated into FIG. 8. For purposes of this illustrative embodiment, a sub-game outcome refers to a sub-group of the letter display elements associated with the overall multiplayer game. In other words, a sub-game outcome is an outcome comprising a sub-group of letter display elements associated with a particular player.

The method is initiated at block 802 where at least two players initiate a primary multiplayer game session in the multiplayer reel game. At block 804, a combined or multiplayer game outcome is generated. At block 806, the illustrative processor 204 proceeds to divide the multiplayer game outcome into a plurality of subgame outcomes for each player. As described above, an example multiplayer game display is shown with respect to FIG. 10.

At block 808, the illustrative processor 204 may analyze the multiplayer game outcome to determine whether the multiplayer outcome includes any winning letter sequences. The illustrative processor 204 may therefore proceed to decision diamond 810, where the illustrative processor 204 may determine whether to award a primary game award to any player in the multiplayer game.

At decision diamond 814, the illustrative processor 204 may determine whether to award a synonym award to any player in the multiplayer game. As shown at block 816, each player contributing to the synonymous letter sequences may receive the synonym award. At decision diamond 818, the illustrative processor 204 may determine whether to award a bonus award to any player in the multiplayer game.

As shown at block 820, each player contributing to the bonus letter sequences may receive the bonus award. However, in various embodiments, and as described below, the bonus awards resulting from a particular primary game session in the multiplayer game may be added or aggregated to generate an aggregated bonus award, and the aggregated bonus award may be evenly distributed between each of the players in the multiplayer game or, in alternative embodiments, proportionally between each player in the multiplayer game contributing to the aggregated bonus award (i.e., between each player contributing a letter or letters to at least one bonus word in the primary multiplayer game session).

At block 822, the illustrative processor 204 may present an option to continue playing the multiplayer game (or to play a new multiplayer game). This option may be presented to each player individually or the option may be presented to the multiplayer group as a whole. Where the option is presented to each player individually, if any player chooses to quit the multiplayer game, the process 800 may end for the terminating player, and the players remaining in the multiplayer game may resume play at block 802. Where the option is presented to the group as a whole, if any player chooses to quit the multiplayer game, the process 800 may end for each player in the group, and any player wishing to continue play may be required to initiate a new multiplayer game at block 802.

Figure 9:
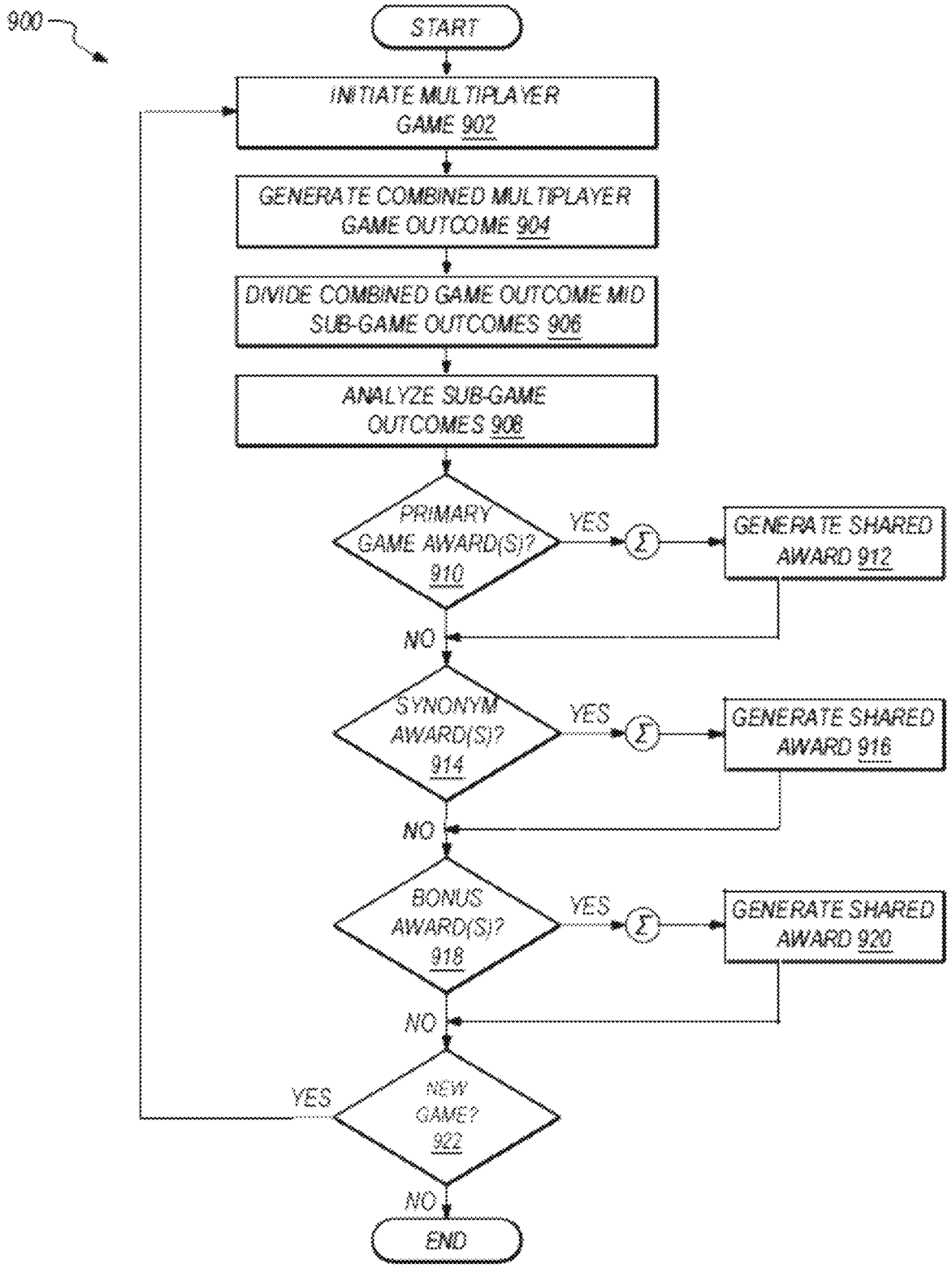
FIG. 9 shows an illustrative flowchart of a multiplayer embodiment of the reel game in which a multiplayer game outcome is divided according to a number of players to generate a plurality of player game outcomes and in which a plurality of awards are aggregated and shared.

Referring to FIG. 9 there is shown an illustrative flowchart 900 of a multiplayer reel game, in which the multiplayer game outcome comprises a plurality of aggregated sub-game outcomes for each player. FIG. 9 is similar to previously described FIG. 6 and FIG. 8; thus, the various methods presented in FIG. 6 are also incorporated into the illustrative FIG. 9 presented hereinafter. For purposes of this illustrative embodiment, an aggregated sub-game outcome refers to a plurality of sub-game outcomes, each sub-game outcome comprising a sub-group of the letter display elements selected from the letter display elements associated with the multiplayer game outcome. In other words, an aggregated sub-game outcome comprises a plurality of sub-groups of letter display elements comprising the overall multiplayer game outcome.

At block 902, at least two players may initiate a primary multiplayer game session in the multiplayer reel game. The illustrative processor 204 may generate, at block 904, a combined or multiplayer game outcome. At block 906, the illustrative processor 204 may divide the multiplayer game outcome to create a plurality of game outcomes for each player in the multiplayer game.

At block 908, the illustrative processor 204 may analyze the multiplayer game outcome to determine whether the multiplayer outcome includes any winning letter sequences. The illustrative processor 204 may analyze the multiplayer game outcome substantially as described above with reference to FIGS. 4A-4C. For example, the illustrative processor may determine whether the multiplayer game outcome (and/or any individual player game outcome) includes excess letters, as described above. Excess letters may be replaced with wild display elements or blank display elements.

As described above, an example multiplayer game display is shown with respect to FIG. 10A. Accordingly, as shown, the illustrative processor 204 may display the game outcome for each player in the multiplayer game display 1000. The multiplayer game display 1000 may be divided into player display sections that each comprise a 3×3 game grid, and each player display section may be associated with a particular player. The number of player display sections may correspond to the number of players in the multiplayer reel game. For example, where there are four players in the multiplayer reel game, the multiplayer game display 1000 may be divided into four player display sections 1002, 1004, 1006, and 1008, each of which may be associated with a particular player. Each player display section 1002, 1004, 1006, and 1008 may include the game outcome (or subgame outcome) associated with a particular player in the multiplayer game.

The multiplayer game display 1000 may be displayed on a large display screen and/or such that each of the plurality of players is able to see the multiplayer game display 1000. For example, the multiplayer game display 1000 may include a stationary or stand-alone wall mounted display, such as a flat panel television screen, a digital sign, or any other publicly accessible or publicly viewable display screen. Thus, each of the players in a multiplayer game may review the multiplayer game outcome as well as each individual player game outcome during game play.

As further described above, the illustrative processor 204 may further search for winning letter sequences within the multiplayer game outcome (and/or within any individual player game outcome) from left to right across a plurality of horizontally adjacent letter display elements. Winning letter sequences may also be formed diagonally, moving from left to right, across a plurality of diagonally adjacent letter display elements. A winning letter sequence may also be formed vertically, moving from top to bottom, down a plurality of vertically adjacent letter display elements along a particular reel.

Winning letter sequences may, in the multiplayer game, be formed between individual player game outcomes. More particularly, winning letter sequences may be formed in the multiplayer game between adjacent player display sections, such as between adjacent player display sections 1002, 1004, 1006, and 1008. Thus, in the multiplayer reel game, players may spell words between the letters comprising their particular game outcome and the letters comprising game outcomes for other participating players displayed in adjacent player display sections (i.e., winning sequences may be spelled within an aggregated sub-game outcome). Accordingly, in the multiplayer reel game, players may improve their chances of forming winning letter sequences, because a greater number of letter display elements may be available for the formation of winning letter sequences. Additionally, players may improve their chances of forming winning letter sequences because longer winning sequences become available in addition to those previously available. For example, winning sequences are limited to three letter display elements on a single 3×3 game grid, but may extend to six letter display elements across two 3×3 game grids.

The illustrative processor 204 may therefore proceed to decision diamond 910, where the illustrative processor 204 may determine whether to award a primary game award to any player in the multiplayer game. The primary game award may be associated, as described above, with a letter sequence that spells a word stored in the game dictionary. A player may receive a primary game award where the game outcome for the player spells a word in the game dictionary and/or where a word is spelled between the game outcome for the player and an adjacent game outcome for another player.

For example, at FIG. 10A, the word "GOLD" is spelled horizontally between the player display sections 1002 and 1004. Similarly, the word "JEWEL" is spelled diagonally between the player display sections 1002, 1006, and 1008, and the word "ACE" is spelled between the player display sections 1004 and 1008. Each of these words may be included in the game dictionary for the multiplayer game and so may result in a primary game award.

In various embodiments, and as shown at block 912, the primary game awards resulting from a particular primary game session in the multiplayer game may be added or aggregated to generate an aggregated primary game award, and the aggregated primary game award may be evenly distributed between each of the players in the multiplayer game or, in alternative embodiments, proportionally between each player in the multiplayer game contributing to the aggregated primary game award (i.e., between each player contributing to at least one winning letter sequence in the primary multiplayer game session).

An aggregated primary game award may be distributed proportionally between players based upon a proportion or percentage of the total letter value associated with the letters contributed by the player to the winning letter sequence. For instance, for the word "GOLD," the letters "GO" are associated with a letter value of "3" (2+1=3), and the letters "LO" are associated with a letter value of "3" (1+2=3). Therefore, the player associated with the letters "GO" may receive 50% of the primary game award, because the word "GOLD" is associated with a total letter value of "6," and the player associated with the letters "GO" contributed 3/6, or 50%, of the total point value to the word. Likewise, the player associated with the letters "LO" may receive 50% of the primary game award, because the player associated with the letters "LO" contributed 3/6, or 50%, of the total point value to the word.

At decision diamond 914, the illustrative processor 204 may determine whether to award a synonym award to any player in the multiplayer game. The synonym award may be associated, as described above, with at least two letter sequences that spell words that are defined as synonyms in the game dictionary. A player may receive a synonym award where the game outcome for the player spells at least two synonyms and/or where the game outcomes for at least two players in the multiplayer game are synonyms. An example game display showing the synonyms "JEWEL" and "GEM" is shown at FIG. 10B.

As shown at block 916, the synonym awards resulting from a particular primary game session in the multiplayer game may be added or aggregated to generate an aggregated synonym award, and the aggregated synonym award may be, like the primary game award described above, evenly distributed between each of the players in the multiplayer game or, in alternative embodiments, proportionally between each player in the multiplayer game contributing to the aggregated synonym award (i.e., between each player contributing to at least one synonymous winning letter sequence in the primary multiplayer game session).

At decision diamond 918, the illustrative processor 204 may determine whether to award a bonus award to any player in the multiplayer game. The bonus award may be associated, as described above, with a word in a list of randomly selected bonus words. A player may receive a bonus award where the game outcome for the player spells a bonus word in the list of bonus words and/or where the game outcomes for at least two players in the multiplayer game collectively spell a word in the list of bonus words.

An example game display 1000 including the bonus word "FLUSH" is shown at FIG. 10C. The bonus word may be outlined or illuminated by a highlighting element 1022, as shown, to highlight that the word is a bonus word. Moreover, although not shown, the highlighting element 1022 may be applied to any winning word in the reel game as described herein, including to a plurality of synonymous words as well as to one or more words associated with a primary game award.

As shown at block 920, the bonus awards resulting from a particular primary game session in the multiplayer game may be added or aggregated to generate an aggregated bonus award, and like the primary game award described above, the aggregated bonus award may be evenly distributed between each of the players in the multiplayer game or, in alternative embodiments, proportionally between each player in the multiplayer game contributing to the aggregated bonus award (i.e., between each player contributing a letter or letters to at least one bonus word in the primary multiplayer game session).

In various embodiments, any of the primary game award, the synonym award, and the bonus award may be averaged, added, or otherwise combined to produce a combined award. The combined award may be allocated between each player in the multiplayer game in any suitable manner. The combined award may be further allocated, in alternative embodiments, between each player in the multiplayer game associated with at least one letter contributing to the generation of the combined award.

At block 922, the illustrative processor 204 may present an option to continue playing the multiplayer game (or to play a new multiplayer game). This option may be presented to each player individually or the option may be presented to the multiplayer group as a whole. Where the option is presented to each player individually, if any player chooses to quit the multiplayer game, the process 900 may end for the terminating player, and the players remaining in the multiplayer game may resume play at block 902. Where the option is presented to the group as a whole, if any player chooses to quit the multiplayer game, the process 900 may end for each player in the group, and any player wishing to continue play may be required to initiate a new multiplayer game at block 902.

In addition to the embodiments presented above, a single player game may be presented in a manner that operates similarly to a multiplayer game. By way of example and not of limitation, a single player game may utilize a plurality of game grids (similar to the multiplayer game shown in FIGS. 10A-10C) and the single player game session may be based on a word(s) being presented across the plurality of game grids, yet controlled by the single player. Thus, the single player game session can simulate the multiplayer game session described above.

Furthermore, when a single player has initiated multiple display sections, the number of bonus words may also be affected so that additional bonus words may be carried over from the previous game sessions. As game play continues and is extended, the number of bonus words increases, which increases the likelihood of the player being awarded a prize.

Figure 11A:
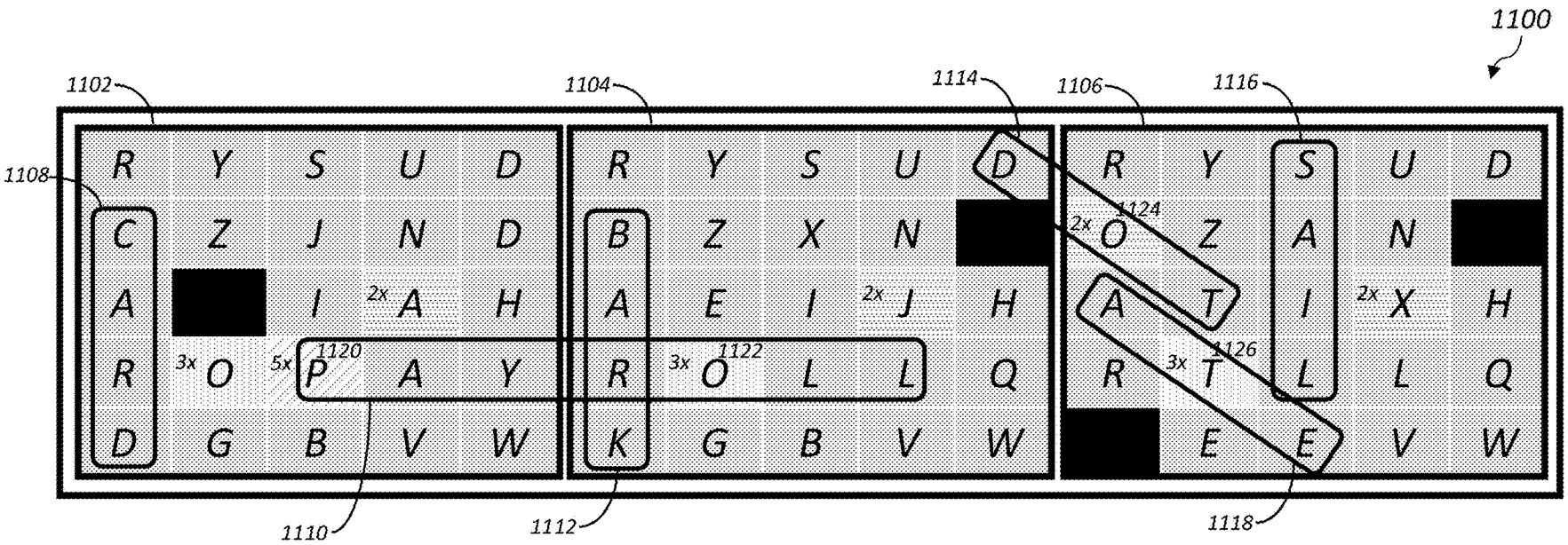
FIG. 11A shows an illustrative single player display screen of three 5×5 game grids.
Figure 11B:
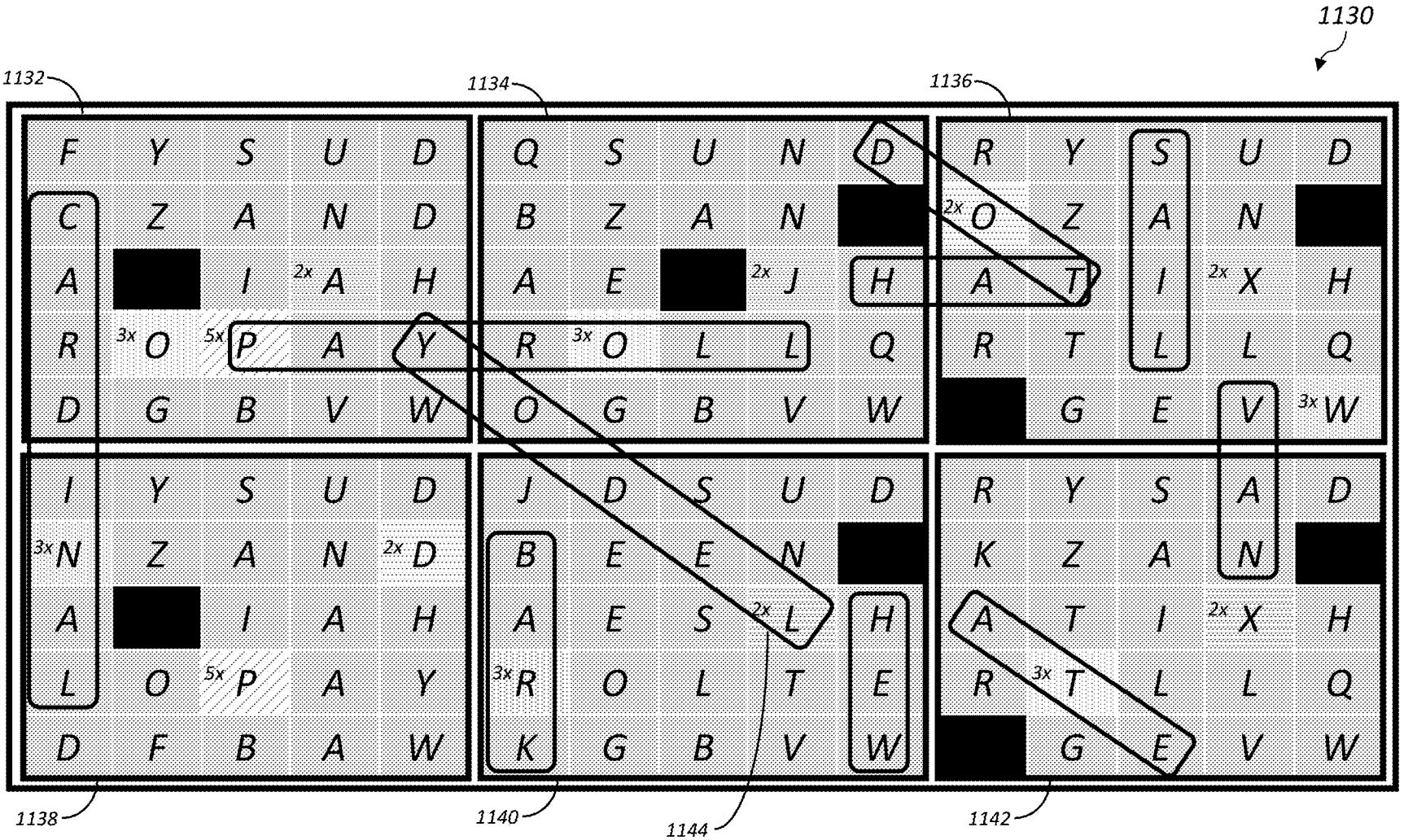
FIG. 11B shows an illustrative single player display screen of six 5×5 game grids.
Figure 11C:
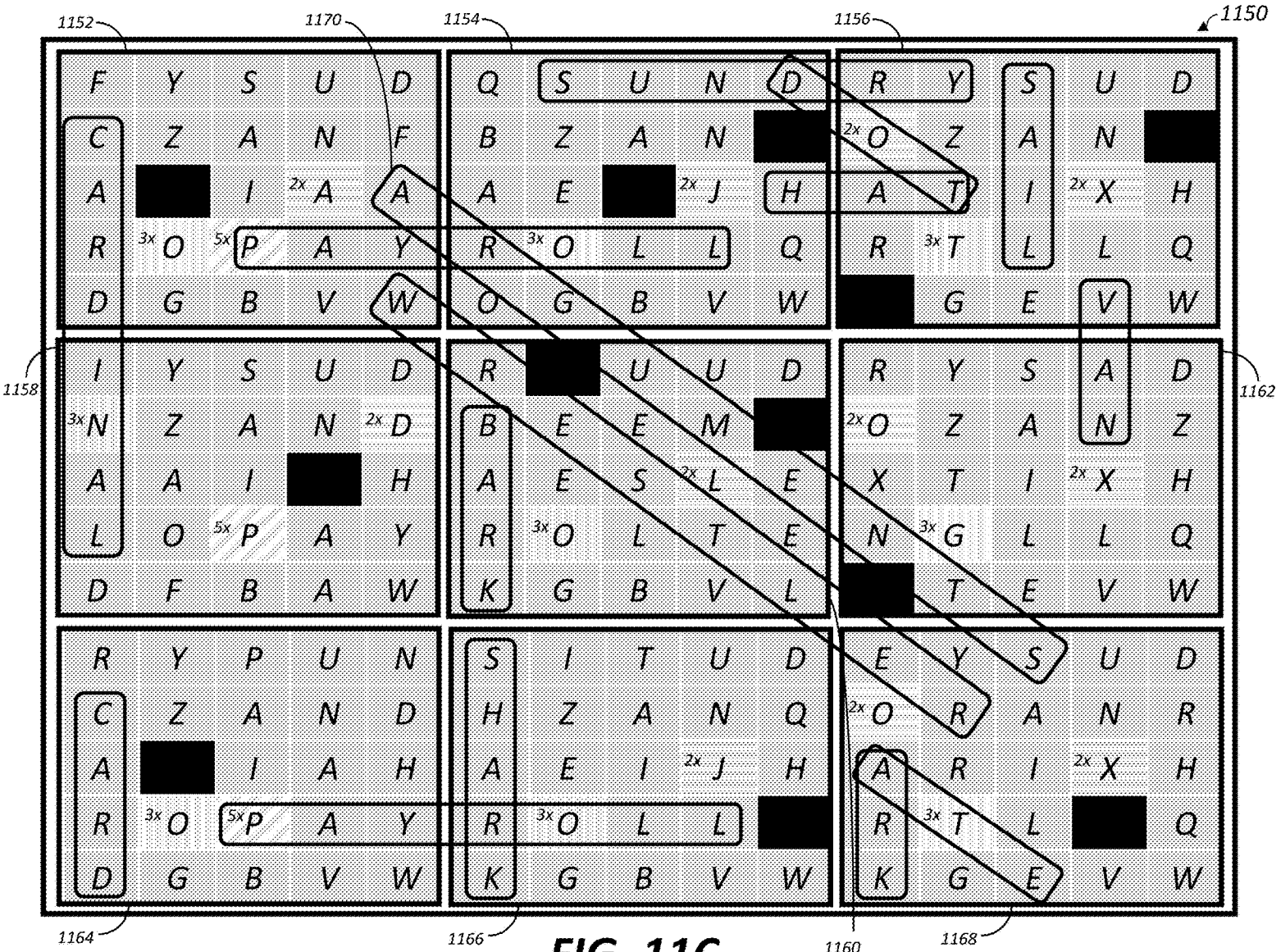
FIG. 11C shows an illustrative single player display screen of nine 5×5 game grids.

Referring now to FIGS. 11A-11C, there are shown exemplary single game displays utilizing multiple game grids. In FIG. 11A, three 5×5 game grids 1102, 1104, and 1106, combine to form one single player game display 1100 on which a single player game outcome is presented. Players may select the use of multiple game grids prior to initiating a game session. Alternatively, players may upgrade during game play from an initial number of game grids to a larger number of game grids.

During gameplay the illustrative processor 204 may search for winning letter sequences within the multiple game grids and between the multiple game grids. More particularly, winning letter sequences may be formed between adjacent game grids of the single player game display 1100, such as between adjacent game grids 1102 and 1104, or between adjacent game grids 1104 and 1106. Thus, in the illustrative multi-game grid single player reel game 1100, a player may spell words between the letters comprising game grids 1102 and 1104, or between the letters comprising game grids 1104 and 1106. Accordingly, in the multiplayer reel game, players may improve their chances of forming winning letter sequences, because a greater number of letter display elements may be available for the formation of winning letter sequences. Additionally, players may improve their chances of forming winning letter sequences because longer winning sequences become available in addition to those previously available. For example, winning sequences are limited to five letter display elements on a single 5×5 game grid, but may extend to fifteen letter display elements across three 5×5 game grids. Although game grids 1102, 1104, and 1106 are arranged linearly and horizontally, this arrangement is not limiting and game grids may be arranged vertically or non-linearly (i.e., two game grids above the third game grid, or one game grid above two other game grids).

The illustrative processor 204 may determine whether to award a primary game award in the multi-game grid single player reel game. The primary game award may be associated, as described above, with a letter sequence that spells a word stored in the game dictionary. A player may receive a primary game award where the game outcome for the player spells a word in the game dictionary and/or where a word is spelled between the game outcome for one game grid and an adjacent game outcome for another game grid.

In the illustrative multi-game grid display 1100, several winning letter sequences 1108, 1110, 1112, 1114, 1116, and 1118 have been identified by the processor 204. Winning sequences 1108, 1112, and 1116 are formed vertically on individual game grids 1102, 1104, and 1106, respectively. Winning sequences 1114 and 1118 are formed diagonally. Winning sequence 1118 is formed on only game grid 1106, while winning sequence 1114 is formed using display elements of game grid 1104 and 1106. Similarly, winning sequence 1110 is formed using display elements from two adjacent game grids, 1102 and 1104.

Winning sequence 1110 uses display element 1120 on game grid 1102 and display element 1122 on game grid 1104 that both include bonus multiplier attributes. The bonus multiplier attribute for display element 1120 is "5×," while the bonus multiplier attribute for display element 1122 is "3×." Thus, the primary award for winning sequence 1110 may be multiplied by the bonus multiplier attributes so that the primary award is 15 times more than without the bonus multipliers. In an alternative calculation, the bonus multiplier attributes may only increase the value of the letter on the corresponding display element.

Winning sequence 1114 uses display element 1124 on game grid 1106 that includes a "2×" bonus multiplier attribute. The "2×" bonus multiplier attribute may increase the value of the primary award for the winning sequence 1114 so that it is twice the value of the primary award for the same winning sequence without the bonus multiplier. Alternatively, the "2×" bonus multiplier may only increase the value of the "0" letter display element 1124 with which it is associated.

Winning sequence 1118 uses display element 1126 that includes a "3×" bonus multiplier attribute. The "3×" bonus multiplier attribute may increase the value of the primary award for the winning sequence 1118 so that it is triple the value of the primary award for the same winning sequence without the bonus multiplier. Alternatively, the "3×" bonus multiplier may only increase the value of the "T" letter display element 1126 with which it is associated.

In FIG. 11B, six 5×5 game grids 1132, 1134, 1136, 1138, 1140, and 1142, combine to form one single player game display 1130 on which a single player game outcome is presented. In the illustrative multi-game grid display 1130, several winning letter sequences have been identified. Winning sequence 1144 is formed using display elements from three adjacent game grids, 1132, 1134, and 1140, instead of merely two adjacent game grids as in FIG. 11A.

In FIG. 11C, nine 5×5 game grids 1152, 1154, 1156, 1158, 1160, 1162, 1164, 1166, and 1168, combine to form one single player game display 1150 on which a single player game outcome is presented. Several winning letter sequences have been identified by the processor 204. Winning sequence 1170 spells "ARGUMENTS" with letter display elements on game grids 1152, 1154, 1160, 1162, and 1168. This winning sequence illustrates that not all game grids used to spell a winning sequence need be adjacent to every other game grid. Instead, each game grid used to spell a winning sequence need only be adjacent to at least one other game grid used to spell that winning sequence.

Figure 12A:
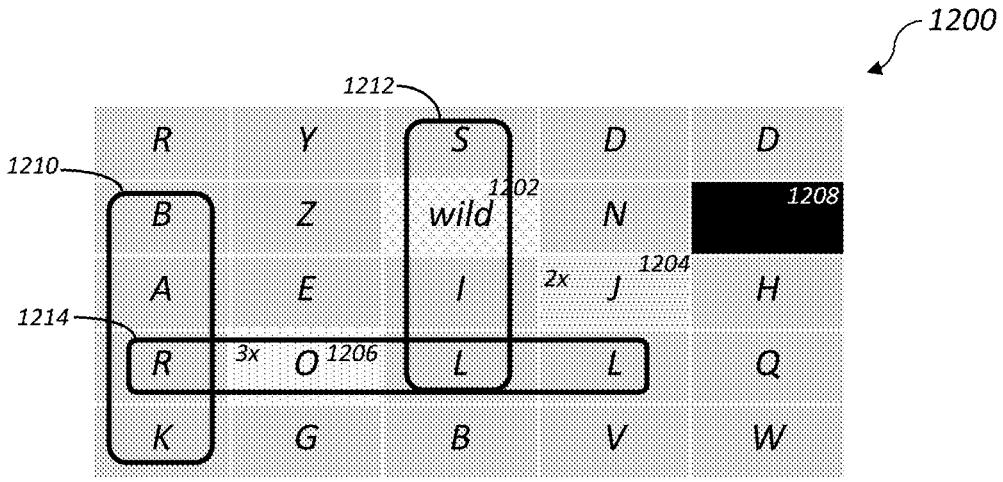
FIG. 12A shows an illustrative display screen of a single player 5×5 game grid with bonus display elements.
Figure 12B:
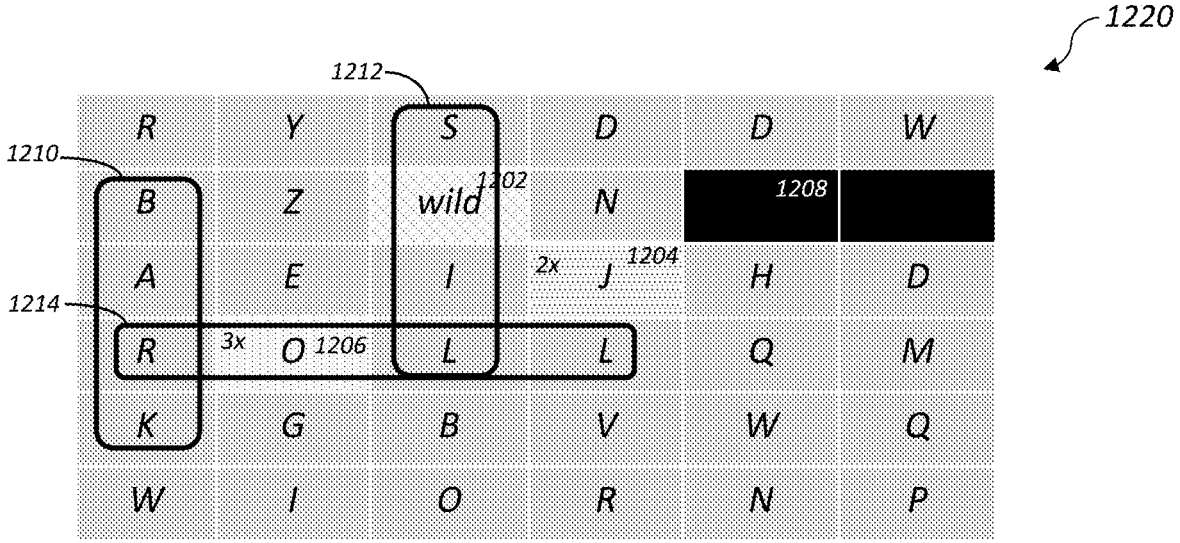
FIG. 12B shows an illustrative display screen of a single player 6×6 game grid with bonus display elements.
Figure 12C:
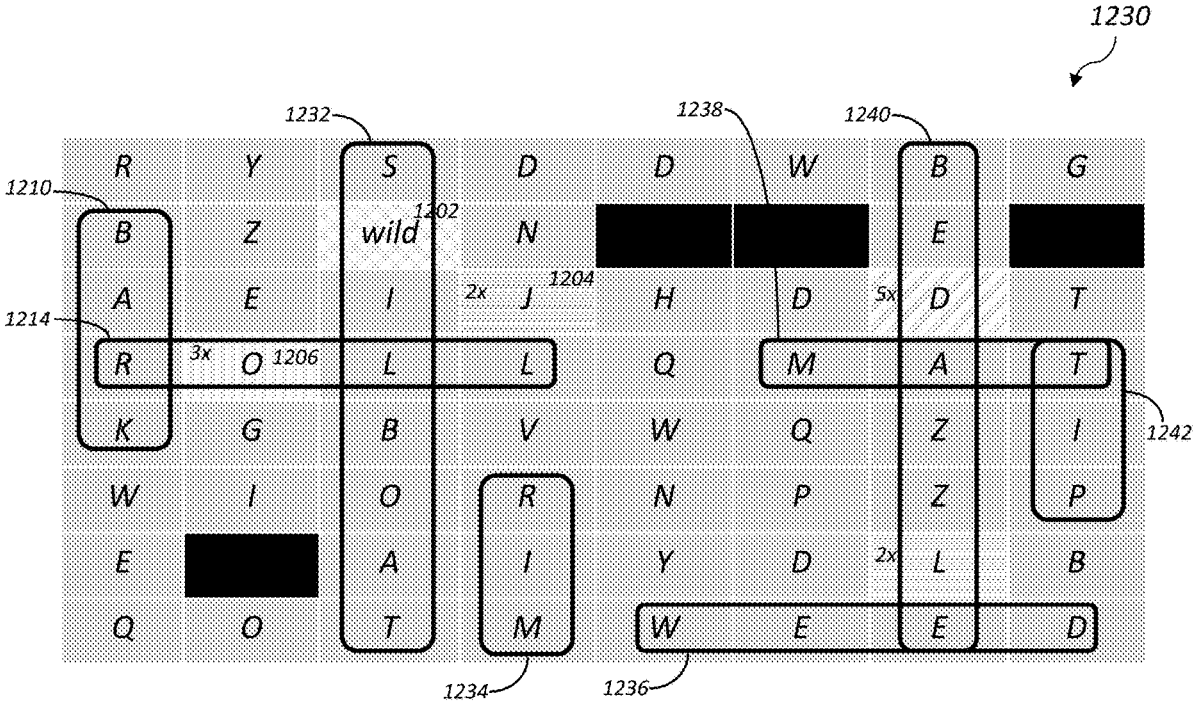
FIG. 12C shows an illustrative display screen of a single player 8×8 game grid with bonus display elements.

In one embodiment, the game grid may expand during or through gameplay from an initial size to a larger size having more reels and/or display elements with which to form winning sequences. The game grid size may be set or determined as a result of a player selection or a value of a game session initiation fee (i.e., the wager size). Thus, as the size of the game grid increases the likelihood of achieving a winning sequence increases. FIGS. 12A-12C show variously sized gaming grids in different stages of expansion.

FIG. 12A shows an illustrative 5×5 game grid 1200 with 25 display elements. The display elements include a "wild" display element 1202, a "2×" multiplier display element 1204, a "3×" multiplier display element 1206, and a black box display element 1208. Three winning sequences 1210, 1212, and 1214 of display elements are circled on the game grid 1200. Winning sequence 1210 is formed from the display elements "B," "A," "R," and "K" spelling the word "BARK" and utilizing no bonus elements. Thus, any award issued for the winning sequence 1210 corresponds merely to the value of the display elements "B," "A," "R," and "K" or the length of the word spelled. Winning sequence 1212 is formed from the display elements "S," "wild," "I," and "L." The processor 204 automatically replaces the "wild" 1202 with an appropriate letter that results in a word contained in the game dictionary. Thus, the winning sequence spells the word "SOIL" or "SAIL" by replacing the "wild" 1202 with a letter "0" or "A." Winning sequence 1214 is formed from the display elements "R," "0," "L," and "L" spelling the word "ROLL" and utilizing the bonus element "3×." The "3×" multiplier 1206 may triple the value of the letter display element with which it is associated, i.e. the letter "0." Alternatively, the "3×" multiplier 1206 may triple the value of the primary game award that would be awarded for the word "ROLL" without any additional bonuses.

FIG. 12B shows an expanded 6×6 game grid 1220 with 36 display elements. The game grid 1220 represents in-game expansion, where the game session initiated or completed a primary game session that resulted in the game grid 1200 of FIG. 12A. Through a player input selection or a processor determination, the game grid 1200 of FIG. 12A expanded by one reel (i.e., game grid column) and one row to form the game grid 1220 that has eleven more display elements for a total of 36 display elements. In the illustrative example, the game display elements of the previous game grid 1200 are maintained and incorporated into the expanded game grid 1220. In an alternative embodiment, the game grid 1200 may expanded after a game outcome is determined, so that the expanded game grid 1220 does not maintain or incorporate any of the previous display elements. When the game grid expands, players may improve their chances of forming winning letter sequences because more letter display elements are available to form winning sequences and longer winning sequences become available in addition to those previously available. Thus, the total number of possible winning sequences or dictionary words in the database increases. For example, winning sequences are limited to five letter display elements on the 5×5 game grid 1200, but may extend to six letter display elements on the expanded 6×6 game grid 1220. Similarly, winning sequences are not limited to five or six letter display elements on the further expanded 8×8 game grid 1230 of FIG. 12C, instead reaching up to eight letter display elements.

The expansion of a player's game grid may occur in multiple stages, beginning with an initial game grid 1200 that expands to the larger game grid 1220, and continues to expand into the even larger game grid 1230, shown in FIG. 12C. The illustrative further expanded game grid 1230 represents an in-game expansion from either game grid 1200, game grid 1220, or any combination thereof. This further expanded game grid 1230 incorporates and maintains the letter display elements of the smaller game grids 1200 and 1220, while adding two more reels (i.e., columns) and two more rows of display elements. As such, game grid 1230 includes the winning sequences 1210 and 1214, as well as several new winning sequences 1232-1242 formed in whole or in part by the additional reels and rows. In particular, winning sequence 1212 from game grids 1200 and 1220 no longer exists because the additional letter display elements incorporated the letter display elements of the winning sequence 1212 to form the longer winning sequence 1232.

Where the game grids 1200 or 1220 expand during a primary game session in response to a player input or processor determination, only the winning sequences on the largest or final game grid are considered by the processor in determining a primary game award. Where the game grids 1200 or 1220 expand in between two game sessions, the player may receive a primary game award for the winning sequences of each game grid.

In some embodiments, the processor 204 may determine to expand a player's game grid in response to a bonus display element being randomly displayed on the player's game grid. Alternatively, the processor 204 may determine to expand a player's game grid in response to a bonus display element being incorporated into a winning sequence. In other embodiments, the processor 204 causes the game grid to expand in response to player input, such as a selection made prior to initiating a game session, during game session initiation, or after game session initiation. In further embodiments, the player input may be the player identifying a winning sequence within a preset time period. This identification may be a player selection made on a touchscreen display.

Figure 13:
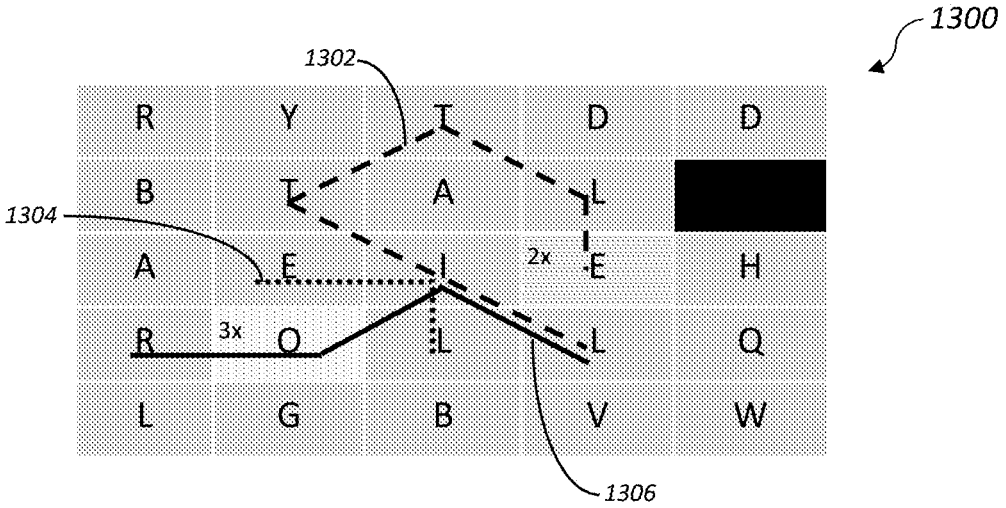
FIG. 13 shows an illustrative display screen of a single player 5×5 game grid with multi-directional non-linear winning sequences.

In another illustrative embodiment, FIG. 13 shows a 5×5 game grid 1300 with non-linear winning sequences 1302, 1304, and 1306. In this embodiment, the non-linear sequences can be formed through a sequence of adjacent display elements. A first display element may be adjacent to another display element when the other display element is immediately below, above, to the right of, to the left of, or diagonal to the first display element. Non-linear winning sequence 1302 links adjacent letter display elements "L," "I," "T," "T," "L," and "E" to spell "LITTLE." Non-linear winning sequence 1304 links adjacent letter display elements "L," "I," and "E" to spell "LIE." Non-linear winning sequence 1306 links adjacent letter display elements "R," "O," "I," and "L" to spell "ROIL."

Notably, non-linear winning sequences 1302, 1304, and 1306 have no directional limit, such as trending right-to-left or top-to-bottom. For example, non-linear winning sequence 1302 trends from bottom-to-top and left-to-right for the first three letter display elements, "L," "I," and "T," then trends from bottom-to-top and right-to-left between the "T" letter display elements, then trends from top-to-bottom and left-to-right between letter display element "T" to letter display element "L," and finally from top-to-bottom between letter display element "L" to letter display element "E." For a further example, non-linear winning sequence 1304 trends from bottom-to-top, then from right-to-left. However, non-linear winning sequence 1306 demonstrates that non-linear winning sequences may trend generally in one direction, i.e. left-to-right, even though this trend varies between bottom-to-top and top-to-bottom through letter display elements "O," "I," and "L."

In yet another illustrative embodiment, the game session may be paused and the game session may be continued at a later time; thus, game play can "persist" after the game session has been paused. For purposes of this patent, persistent game play enables a player to step away from the game and then to return to the game session or game play with the same prizes, bonuses, power-ups or other such game events that increasing the likelihood of having the player win an award. By way of example and not of limitation, persistent game play enables the gaming system or gaming device to pause the game session or game play for an extended period of time when the player decides to switch to another game or play on another gaming device. Additionally, persistent game play allows the player to pause the game session and then resume the corresponding game session at a later time and even later date. Furthermore, persistent game play may exist across a plurality of networked gaming machines so the player can preserve the game session not just for a particular gaming machine; thus, the same prizes, bonuses, power-ups or other such game events that increase the likelihood of having the player win an award may be stored on a server and linked to the player using a loyalty program, e.g. a player rewards card. Additionally, the player may also provide user credentials such as username and password to access a networked gaming device that supports persistent game play.

By way of example and not of limitation, the game, systems and methods presented herein enable a player to watch a word pattern emerge in a word find game, which is more engaging that watching well-known slot machine games. The game, systems and methods may operate using various word grid sizes and shapes. For example, a 5×5 matrix may be used to present the game. Thus, the shape and size of the grids that are presented herein are for illustrative purposes only.

The descriptions of the systems described herein are not intended to limit the teachings or applicability of this disclosure. For example, the processing of the various components of the illustrated systems may be distributed across multiple machines, networks, and other computing resources. In addition, two or more component of a system may be combined into fewer components. While some examples of possible connections between systems are shown, any of the components shown herein may communicate with any other subset of component in various implementations.

Depending on the embodiment, any of the functions or actions may be performed in a different sequence, may be added, merged or left out altogether (e.g., not all described acts or events are necessary for the practice of the algorithms). Moreover, in certain embodiments, acts or events may be performed concurrently, e.g. though multi-threaded processing, interrupt processing, or multiple processors or processor cores or on other parallel architectures, rather than sequentially.

The various features and processes described may be used independently of one another, or may be combined in various ways. All possible combinations and sub-combinations are intended to fall within the scope of this disclosure. In addition, certain method or process blocks or steps may be omitted in some implementations. The methods described herein are also not limited to any particular sequence, and the blocks or steps relating thereof can be performed in other sequences that are appropriate. For example, described blocks or steps may be performed in an order other than that specifically disclosed, or multiple blocks or steps may be combined in a single block or step. The example blocks or steps may be in serial, in parallel, or in some other manner. Blocks or steps may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might, "may," "e.g.," and the like, unless specifically stated otherwise, or otherwise understood with the context as used, is generally intended to convey that certain embodiments include, while other embodiments do not include, certain features, elements, and/or steps. Thus, such conditional language is not generally intended to imply that features, elements and/or steps are in any way required for one or more embodiment or that one or more embodiments necessary include logic for deciding, with or without author input or prompting, whether these features, elements, and/or steps are included or are to be performed in any particular embodiment. The terms "comprising," "including," "having," and the like are synonymous and are used inclusively, in an open-ended fashion, and do not exclude additionally elements, features, acts, operations, and so forth. Also, the term "or" is used in its inclusive (and not in its exclusive sense) so that when used for example, to connect a list of elements, the term "or" means one, some or all of the elements of the list.

While certain embodiments have been described, these embodiments have been presented by way of example only, and are not intended to limit the scope of the disclosures herein. Thus, nothing in the foregoing description is intended to imply that any particular feature, characteristic, step, module, or block is necessary or indispensable. Indeed, the novel methods and systems described herein may be embodied in a variety of other forms; furthermore, various omission, substitutions and changes in the form of the methods and systems described herein may be made without departing from the spirit of the disclosures herein.

It is to be understood that the detailed description of illustrative embodiments is provided for illustrative purposes. Thus, the degree of software modularity for the gaming system and method presented above may evolve to benefit from the improved performance and lower cost of the future hardware components that meet the system and method requirements presented. The scope of the claims is not limited to these specific embodiments or examples. Therefore, various process limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. A skill-based reel gaming system comprising:

a housing;

a display device supported by the housing, the display device including a touchscreen configured to receive a player input, the display device further configured to present game session outcomes;

a processor configured for game play; and a tangible, non-transitory, memory configured to communicate with the processor, the tangible, non-transitory, memory having instructions stored thereon in response to execution by the processor, cause the processor to perform operations comprising:

initiating a game session having a game grid size;

randomly selecting a plurality of letter display elements that correspond to a game outcome;

determining whether any of the plurality of letter display elements form a winning sequence of letter display elements, wherein the winning sequence of letter display elements correspond to a word stored in a word database and wherein the plurality of letter display elements include bonus attributes, the bonus attributes including a letter value multiplier and a free spin prize;

receiving a player input through the touchscreen corresponding to the winning sequence of letter display elements; and awarding a game session prize based upon the plurality of letter display elements and the player input.

2. The reel-based gaming system of claim 1 further comprising:

comparing each letter of the plurality of letter display elements to a particular letter limit;

identifying a selected letter from the plurality of letter display elements that exceeds the particular letter limit, the identified letter comprising an excess letter;

replacing a letter display element associated with the excess letter with a letter display element that includes one of a blank letter display element and a wild letter display element; and displaying the plurality of letter display elements and one of the blank letter display element and the wild letter display element on the display device.

3. The reel-based gaming system of claim 1 wherein each of the selected plurality of letter display elements is associated with a particular letter limit.

4. The reel-based gaming system of claim 1 further comprising:

displaying an option to view a word definition in association with the winning sequence; and displaying the word definition in response to a selection of the option.

5. The reel-based gaming system of claim 1 further comprising:

determining that a plurality of winning sequences are formed;

determining that at least two of the winning sequences correspond to synonymous words;

receiving a player input corresponding to each of the at least two synonymous word winning sequences; and determining a synonym prize in response to the determining that at least two of the winning sequences correspond to synonymous words and the player input corresponding to each of the at least two synonymous word winning sequences.

6. The reel-based gaming system of claim 1 wherein the game session prize is based upon a number of letter display elements comprising the winning sequence.

7. The reel-based gaming system of claim 1 further comprising:

determining that a plurality of winning sequences are formed;

receiving a player input corresponding to each of the plurality of winning sequences; and awarding a prize for each of the plurality of winning sequences formed and the corresponding received player input.

8. The reel-based gaming system of claim 1 further comprising determining the game session game grid size based upon a value of a game session initiation fee.

9. The reel-based gaming system of claim 1 further comprising initiating a second game session having a game grid size based upon the game session outcome.

10. The reel-based gaming system of claim 1 wherein the game session further comprises multiple game grids.

11. A reel-based gaming method comprising:

initiating, by a processor, a game session having a game grid size;

selecting, by the processor, a plurality of letters at random that correspond to a game session outcome, wherein the processor communicatively coupled to a tangible, non-transitory, memory and a display device, the memory having instructions stored thereon, the display device supported by a housing and including a touchscreen;

associating, by the processor according to the instructions stored on the memory, the selected plurality of letters with a plurality of letter display elements;

displaying, by the display device, the plurality of letter display elements;

determining, by the processor according to the instructions stored on the memory, whether any of the plurality of letter display elements form a winning sequence of letter display elements, a winning sequence of letter display elements corresponding to a word stored in a word database and wherein the plurality of letter display elements include bonus attributes, the bonus attributes including a letter value multiplier and a free spin prize;

receiving, by the touchscreen, a player input corresponding to the winning sequence of letter display elements; and awarding, by the processor in response to determining that a winning sequence is formed and receiving the player input, a game session prize.

12. The reel-based gaming method of claim 11 further comprising:

comparing, by the processor according to the instructions stored on the memory, each letter in the plurality of letters to a particular letter limit;

identifying, by the processor according to the instructions stored on the memory, a selected letter from the plurality of letters that exceeds the particular letter limit, the identified letter comprising an excess letter; and replacing, by the processor according to the instructions stored on the memory, a letter display element associated with the excess letter with a display element selected from a blank display element or a wild display element.

13. The reel-based gaming method of claim 11 wherein each of the selected plurality of letter is associated with a particular letter limit.

14. The reel-based gaming method of claim 11 further comprising:

displaying an option to view a word definition in association with the winning sequence; and displaying, in response to a selection of the option, the word definition.

15. The reel-based gaming method of claim 11 further comprising:

determining, by the processor according to the instructions stored on the memory, that a plurality of winning sequences are formed;

determining, by the processor according to the instructions stored on the memory, that at least two of the winning sequences correspond to synonymous words;

receiving, by the touchscreen, a player input corresponding to each of the at least two synonymous word winning sequences; and determining, by the processor according to the instructions stored on the memory, a synonym prize in response to the determining that at least two of the winning sequences correspond to synonymous words and the player input corresponding to each of the at least two synonymous word winning sequences.

16. The reel-based gaming method of claim 11 wherein the game session prize is based upon a number of letter display elements comprising the winning sequence.

17. The reel-based gaming method of claim 11 further comprising:

determining, by the processor according to the instructions stored on the memory, that a plurality of winning sequences are formed;

receiving, by the touchscreen, a player input corresponding to each of the plurality of winning sequences; and awarding, by the processor according to the instructions stored on the memory, a prize for each of the plurality of winning sequences formed and the corresponding received player input.

18. The reel-based gaming method of claim 11 further comprising determining the game session game grid size based upon a value of a game session initiation fee.

19. The reel-based gaming method of claim 11 further comprising initiating a second game session having a game grid size based upon the game session outcome.

20. The reel-based gaming method of claim 11 wherein the game session further comprises multiple game grids.

* * * * *